US005250989A

United States Patent [19]

Morita et al.

[11] Patent Number: 5,250,989

[45] Date of Patent: Oct. 5, 1993

[54] IMAGE FORMING APPARATUS HAVING DETACHABLE PROCESS CARTRIDGE WITH PROTECTIVE TRANSFER ZONE COVER

[75] Inventors: Shizuo Morita, Tachikawa; Masakazu Fukuchi, Hachioji; Satoshi Haneda, Hachioji; Hisao Satoh, Hachioji; Tadayoshi Ikeda, Hachioji, all of Japan

[73] Assignee: Konica Corporation, Tokyo, Japan

[21] Appl. No.: 985,242

[22] Filed: Dec. 2, 1992

Related U.S. Application Data

[63] Continuation of Ser. No. 788,798, Nov. 5, 1991, abandoned.

[30] Foreign Application Priority Data

| | | | |
|---|---|---|---|
| Nov. 10, 1990 | [JP] | Japan | 2-305537 |
| Mar. 28, 1991 | [JP] | Japan | 3-064661 |
| Apr. 22, 1991 | [JP] | Japan | 3-090191 |

[51] Int. Cl.[5] ..... G03G 15/00

[52] U.S. Cl. ..... 355/210; 355/212

[58] Field of Search ..... 355/200, 210, 212

[56] References Cited

U.S. PATENT DOCUMENTS

| | | | |
|---|---|---|---|
| 4,470,689 | 9/1984 | Nomura et al. . | |
| 4,588,280 | 5/1986 | Ogawa et al. . | |
| 4,634,264 | 1/1987 | Takahashi . | |
| 4,786,937 | 11/1988 | Bouwens . | |
| 4,791,454 | 12/1988 | Takahashi et al. . | |
| 4,829,334 | 5/1989 | Takamatsu et al. | 355/309 |
| 4,875,977 | 10/1989 | Takamatsu et al. | 355/212 |
| 5,061,959 | 10/1991 | Kinoshita et al. | 355/210 |
| 5,062,003 | 10/1991 | Kawabata | 355/202 X |
| 5,065,195 | 11/1991 | Haneda et al. | 355/298 |

*Primary Examiner*—R. L. Moses

*Attorney, Agent, or Firm*—Finnegan, Henderson, Farabow, Garrett & Dunner

[57] ABSTRACT

Image forming apparatus provided with a process cartridge including at least a belt-shaped image carrier. A protective cover automatically covers a transfer section of the image carrier installed in the process cartridge, in response to a traveling motion of the process cartridge from a first position in which an image can be formed, to a second position in which the process cartridge can be attached to or detached from the apparatus. The protective cover also automatically exposes the transfer section of the image carrier in response to the input of a power source to the apparatus, or the input of an image forming signal for forming a latent image on the image carrier, or the process of mounting of the process cartridge to the apparatus.

6 Claims, 20 Drawing Sheets

IMAGE FORMING APPARATUS HAVING DETACHABLE PROCESS CARTRIDGE WITH PROTECTIVE TRANSFER ZONE COVER

This application is a continuation of application Ser. No. 07/788,798, filed Nov. 5, 1991, now abandoned.

BACKGROUND OF THE INVENTION

The present invention relates to an electrophotographic image forming apparatus for forming an image on a transfer sheet of a copier or printer, and more particularly relates to an image forming apparatus to which processing components for image formation including an image carrier are provided in the form of one unit.

Many methods and apparatus for obtaining color images using an electrophotographic method have been proposed. For example, as indicated in Japanese Patent Publication Open to Public Inspection No. 100770/1986, there is a method in which latent images are formed on a photosensitive drum, which is an image forming unit. Depending on the number of separated colors of an original image, the latent images are transferred onto a transfer drum after being developed so as to form a multi-color image on the transfer drum, and then they are transferred onto a transfer sheet so as to obtain a color copy. An apparatus using this method requires a transfer drum, the diameter of which is large enough to transfer one sheet of image onto the peripheral surface thereof, in addition to the photosensitive drum. The size of the apparatus is inevitably large and the structure is complicated.

Furthermore, for example, as indicated in Japanese Patent Publication Open to Public Inspection No. 149972/1986, there is a method in which latent images are formed and developed on a photoreceptor drum, depending on the number of separated colors of an original image. The latent images are transferred onto a transfer sheet when they are developed so as to obtain a multi-color copy. It is difficult in this method to registrate numerous color images with high accuracy, and color copies of good quality can not be obtained.

Furthermore, there is a method in which latent images are formed on a photosensitive drum, depending on the number of separated colors of an original image, and developed by color toners, repeatedly. In this matter, color toner images are registered on the photosensitive drum and transferred so as to form a color image. This basic process of multi-color image forming is indicated in Japanese Patent Publication Open to Public Inspection Nos. 75850/1985, 76766/1985, 95456/1985, 95458/1985, and 158475/1985 by the applicants of this application.

A multi-color image forming apparatus for forming color images by registration includes a plurality of developing units containing different color toners installed around the photosensitive drum. Latent images on the photosensitive drum are developed generally by rotating the photosensitive drum several times so as to form color images.

In an image forming apparatus, such as a monochromatic color analog copier using the electrophotographic method or a copier or printer using a semiconductor laser LED scanning system, an apparatus has been proposed in which a part of the image forming means is provided as a cartridge unit. The cartridge unit is used for replenishing or replacing various photoconductors of limited durability, developer carriers, cleaning materials, and developing toners when they are exhausted, whereby the integrated unit of the essential units of these image forming means is removed for maintenance or replacement. Various structures have been proposed, for example, configuring the feed path of a transfer sheet whereon an image is formed by the image forming means to be opened so that the transfer can be easily removed for clearing a jam.

A typical structure in which a photosensitive drum, developing unit, and cleaner are integrally mounted on a support member so that they can be removed from the main unit and each unit can be easily replaced or repaired is indicated in Japanese Patent Publication No. 54392/1983. A structure in which the essential units of the image forming means are integrated and not reused is indicated in Japanese Patent Publication Open to Public Inspection No. 154255/1982 Likewise a printer structure in which a non-reusable cartridge is used such that latent images are formed on a photosensitive drum by the dot, exposure scanning of a semiconductor laser is indicated in Japanese Patent Publication Open to Public Inspection No. 147366/1984.

Furthermore, the aforementioned publication indicates a structure in which the upper frame of the divided structure is opened so as to open the transfer sheet feed path, whereby the transfer sheet can be easily removed in the case of jamming. Japanese Patent Publication Open to Public Inspection No. 154255/1982 mentioned above indicates a structure in which a non-reusable process cartridge is mounted on the upper frame of the bisecting structure so that it can be replaced, increasing operability of cartridge replacement and the ease of jam clearance. A structure in which priority is given to the ease of process cartridge replacement, such as a replenishing toner cartridge or a collected toner cleaning cartridge, is indicated in Japanese Patent Publication Open to Public Inspection No. 1161/1983. In it particularly noted that a process cartridge, is mounted on the lower frame so as to improve the operability of maintenance.

A structure in which a vertical type of the aforementioned structure is used so as to improve the same directional operation and jam clearance is indicated in Japanese Patent Publication Open to Public Inspection Nos. 244058/1988, 244059/1988, 244064/1988, and 179168/1989.

However, a compact printer having a process cartridge, which comprises a developing unit and an image carrying member, which can be easily provided to or removed from the apparatus body, which is free of leakage or spilling of toner or developer from the developing unit when it is provided to or removed from the apparatus body, and which is free of such problems during clearance of a jammed transfer sheet, has not yet been proposed.

A proposal in which when the upper frame of a printer of bisecting structure is open, a process cartridge mounted on the upper frame is always kept horizontal so as to prevent waste toner from spilling, is indicated in Japanese Patent Publication Open to Public Inspection No. 190961/1983. Although this structure allows the cartridge to be easily mounted or a jam to be easily cleared, problems such as spilling or leakage of toner caused when the cartridge is mounted, a jam is cleared, or a replacement operation is performed for maintenance, have not been solved.

In Japanese Patent Publication Open to Public Inspection No. 72159/1983 is disclosed a printer having a bisecting structure wherein a jam can be easily cleared, and a non-reusable cartridge is mounted on the upper frame. In Japanese Patent Publication Open to Public Inspection No. 1161/1983, a replenishing or collected toner can be easily replaced; a process cartridge is mounted on the lower frame; and the process cartridge of a developing unit, cleaning unit, and photosensitive drum can be raised for clearing a jam. However, the operability of the process cartridge replacement conflicts with the ease of jam clearance. Furthermore, in these process cartridges, since the developing unit and the cleaning unit are mounted at the bottom across the paper feed path from the transfer electrode, toner spills from the developing unit or the cleaning unit cause the inside of the apparatus or the transfer paper to become soiled. This occurs if the process cartridge is positively sealed when the process cartridge is replaced or external vibration or shock is applied to the apparatus body.

The printer indicated in Japanese Utility Model Laid Open to Public Inspection No. 195357/1988 contains a process cartridge and forms a flat paper feed path at the upper part. However, there are some restrictions on the feed path from the transfer sheet separation unit of the photosensitive drum to the fixing unit, and problems of the feed unit have not been solved. Furthermore, the printer lacks ease of jam clearance when it is opened, such that compactness is restricted due to the upstanding stack paper feeding structure, and the opening angle of the upper frame. Therefore, the printer is not an apparatus which is superior in operability.

As to a color image forming unit, as described previously, a belt type image forming unit wherein a photoconductor is coated or deposited on a flexible belt has been proposed. For example, in Japanese Patent Publication Open to Public Inspection No. 55573/1991 by the applicant of this application a photosensitive drum is provided by a photoconductor which is coated or deposited on the peripheral surface of the drum. The shape of the belt type of image forming unit (hereinafter called a photosensitive belt) is determined by stretching the photosensitive belt between between rotating rollers, including a drive roller. The belt type of image forming unit is effective from the viewpoint of compactness, using space effectively. Since the photosensitive belt can move around a small curvature, defective separation of a transfer sheet can be prevented by separating the transfer sheet using the curvature of a rotating roller with a small diameter.

In a color image forming apparatus using such a photosensitive belt, image forming means such as a charging means, an image exposure means, a plurality of developing units, and a cleaning means are installed mainly below the lower surface of the outer peripheral surface of the photosensitive belt. Those components which make up the and those image forming means are integrated in a process cartridge together with the photosensitive belt, and the process cartridge can be freely provided to or dismounted from the apparatus body.

A transfer sheet whereon a color toner image is transferred is ejected onto a paper ejection tray installed on the top of the apparatus with the copy side down. Therefore, the necessary area of a place where the apparatus is to be installed, is small.

A structure in which problems of paper feed and jam clearance are solved by using a compact cartridge and the same side operation is possible, as indicated in Japanese Patent Publication Open to Public Inspection Nos. 40850/1989 and 244059/1988.

A concept of control for outputting an indication showing the exhaustion of a process cartridge or the expiration of the life of a photoconductor, is indicated in Japanese Patent Publication Open to Public Inspection No. 85763/1988. However, an image forming apparatus, which is compact and easy to operate and satisfies all the requirements such as easy jam clearance, no spilling of toner during cartridge operations, easy cartridge replacement, and all operations available from one side via the front of the apparatus body, has not been proposed. A concept to provide a protective cover in order to prevent a photoreceptor from being damaged when it is attached to and detached from the apparatus, has been disclosed in the official gazette of Japanese Patent Publication Open to Public Inspection 211181/1982. Likewise, and a concept to open and close a cover being linked with the motion of opening when the apparatus is bisected, has been disclosed in the official gazette of Japanese Patent Publication Open to Public Inspection 181062/1983. However, the aforementioned structure is not suitable for the opening and closing motion of the cover in accordance with the position of the cartridge. The opening is formed on the edge of the transfer section, so that the opening is not adequate to be used for maintenance.

In the case of a color image forming apparatus, a plurality of developing units and a plurality of toner supplying units are provided. Therefore, the structure of the image forming section is complicated, so that it is very difficult to inspect, replace, or replenish each component for processing use.

In order to solve the aforementioned problem, the image forming apparatus is structured in such a manner that at least a photoreceptor and a cleaning unit are integrally provided in a cartridge; or a photoreceptor, a developing unit and a cleaning unit are integrally provided in a cartridge, so that the aforementioned cartridge can be easily removed from the apparatus body.

In the case of the aforementioned cartridge, most of the photosensitive surface of the photoreceptor is covered. However, the exposure and transfer zone are not covered, so that when the cartridge is located inside the apparatus body, it may be soiled with dust, and when the cartridge is taken out of the apparatus, there is a possibility that the exposure and transfer region may be soiled or damaged by hands or other objects.

It is a primary object of the present invention to provide an image forming apparatus characterized in that: articles of consumption can be easily replaced; components can be easily maintained and replaced; jam clearance can be easily conducted; and the photoreceptor can be protected during the operation.

The second object of the present invention is to provide an image forming apparatus characterized in that the exposure and transfer zone of the photoreceptor are always covered except when the image formation process operation is being conducted so that the photosensitive surface of the photoreceptor can be protected.

SUMMARY OF THE INVENTION

The first structure of the image forming apparatus according to the present invention is characterized in that, in an image forming apparatus in which a process cartridge including at least a belt-shaped image carrier is provided, a protective cover automatically covers a transfer section of the image carrier installed in the process cartridge, being linked with the traveling motion of the process cartridge from a first position in which an image can be formed by the aforementioned process cartridge, to a second position in which the process cartridge can be attached to or detached from the apparatus.

The second structure of the image forming apparatus according to the present invention in order to accomplish the aforementioned object is characterized in that, in an image forming apparatus provided with a detachable process cartridge having at least an image carrier and a cleaning member, a cover member provided in an image transfer zone of the aforementioned image carrier is open during the period of time in which image forming processing is conducted by the aforementioned apparatus.

The third structure of the image forming apparatus according to the present invention in order to accomplish the aforementioned object is characterized in that, in an image forming apparatus provided with a process cartridge having at least an image carrier and a cleaning member, a cover member installed at least in an image transfer zone of the aforementioned image carrier is opened in accordance with the input of a power source of the aforementioned apparatus or the input of an image forming signal.

The fourth structure of the image forming apparatus according to the present invention in order to accomplish the aforementioned object is characterized in that, in an image forming apparatus in which a process cartridge; having a belt-shaped photoreceptor and processing means for image formation provided in the peripheral portion thereof, is detachably provided, a cover member is opened which is provided both in an image transfer zone and image exposure zone of the aforementioned belt-shaped photoreceptor, when the aforementioned process cartridge is installed in the aforementioned apparatus.

DESCRIPTION OF THE PREFERRED EMBODIMENTS

Figure 7:
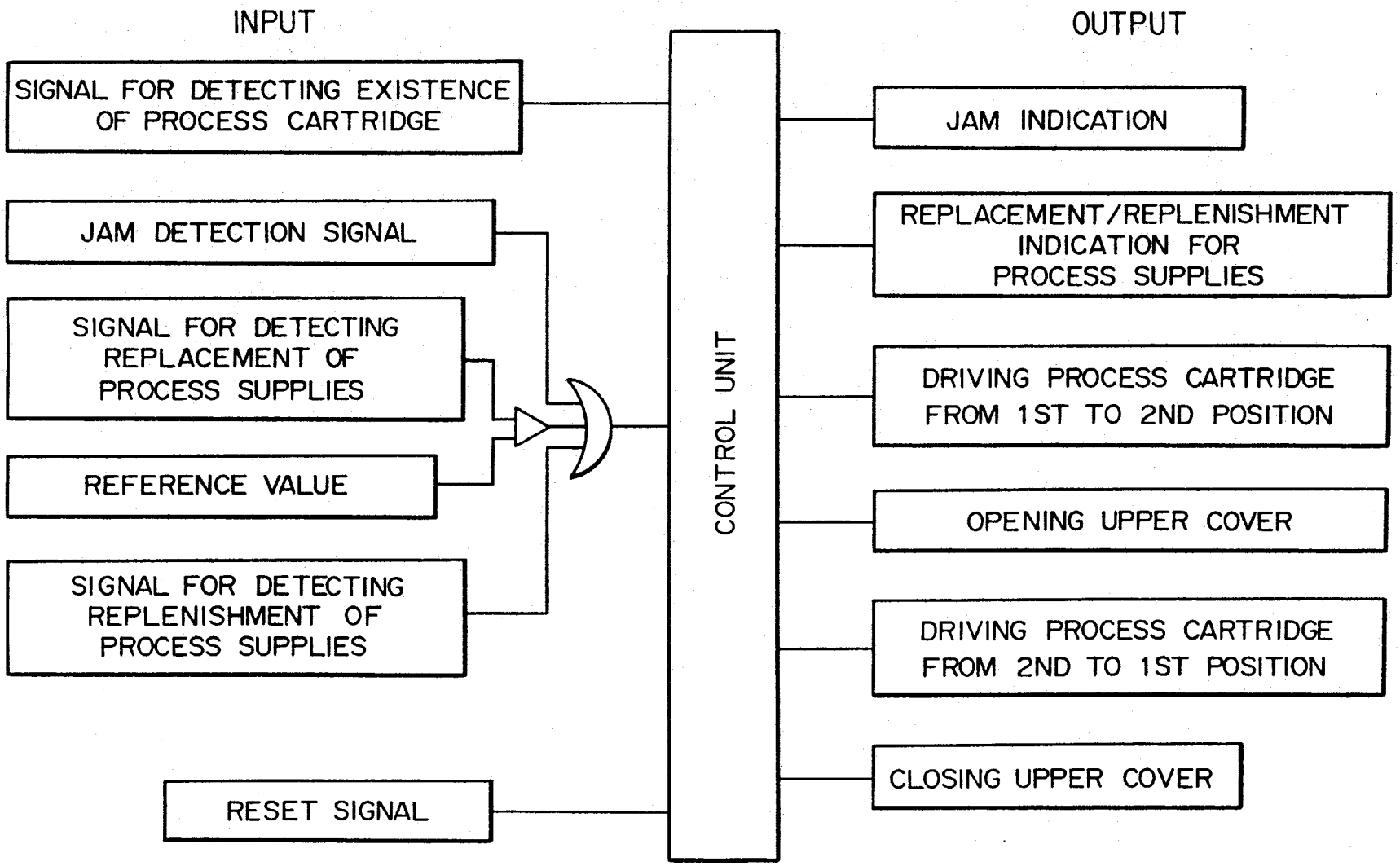
FIG. 7 is a control circuit diagram.
Figure 8:
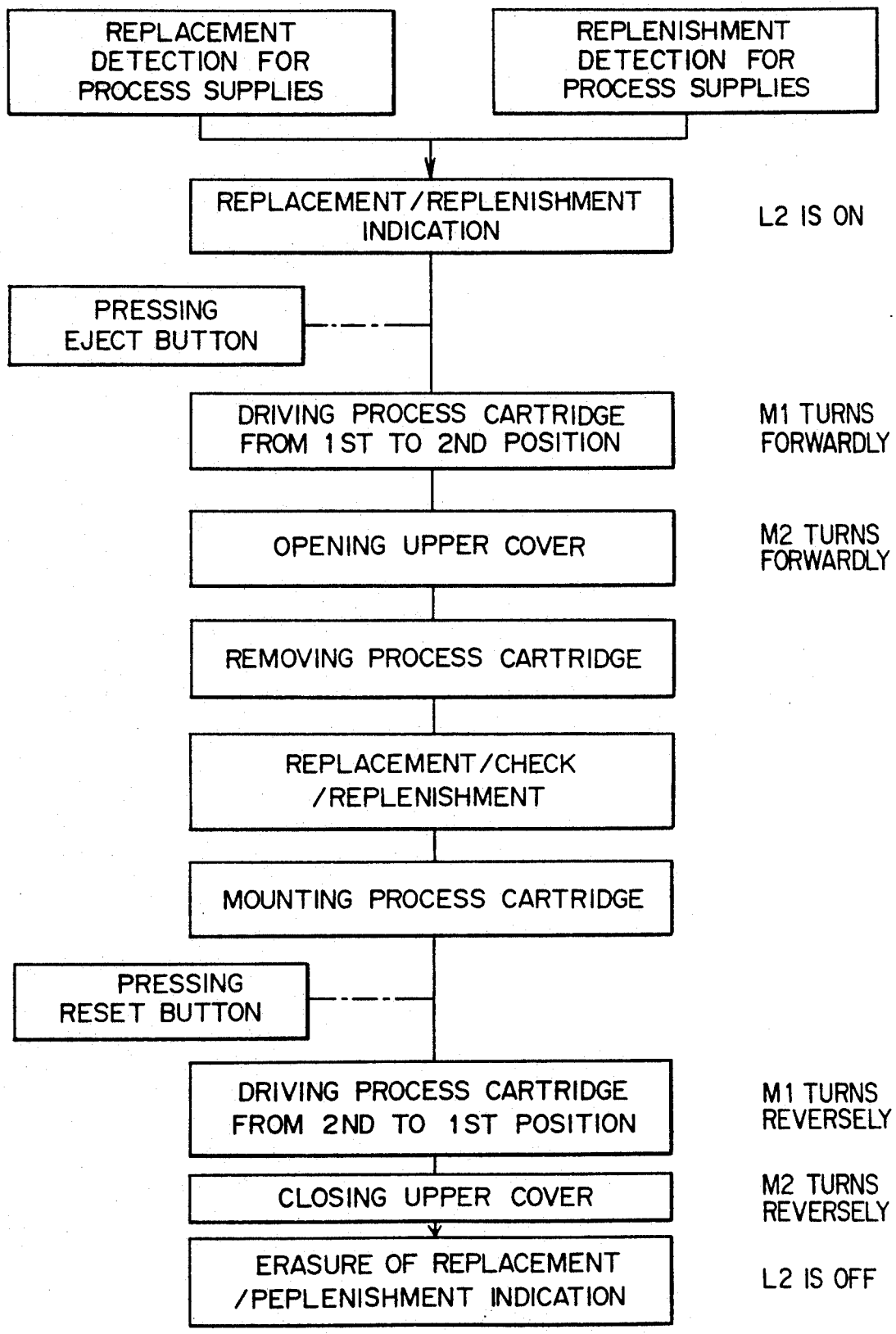
FIGS. 8(*a*) and 8(*b*) are flow charts showing the control process.
Figure 8:
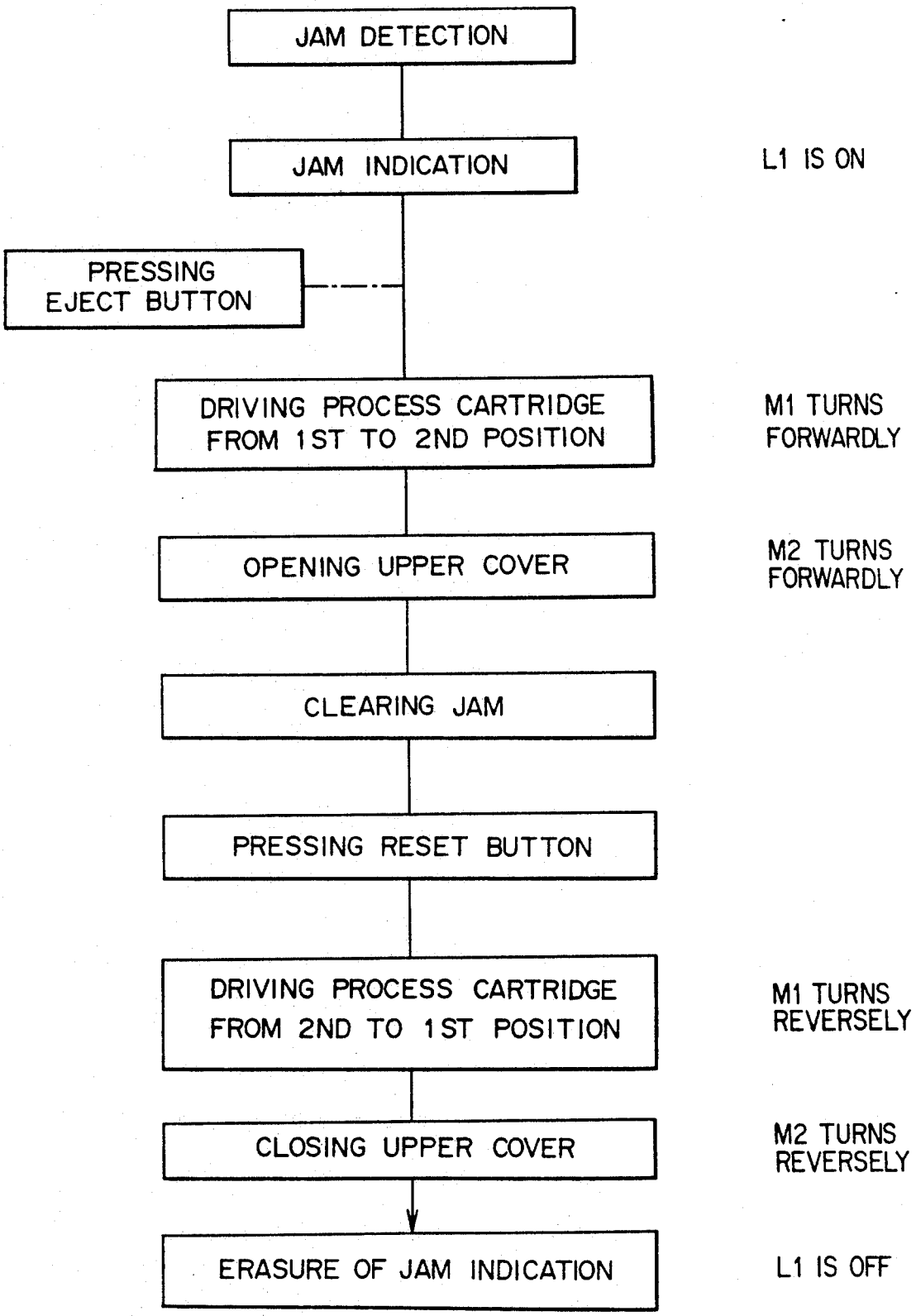
Figure 9:
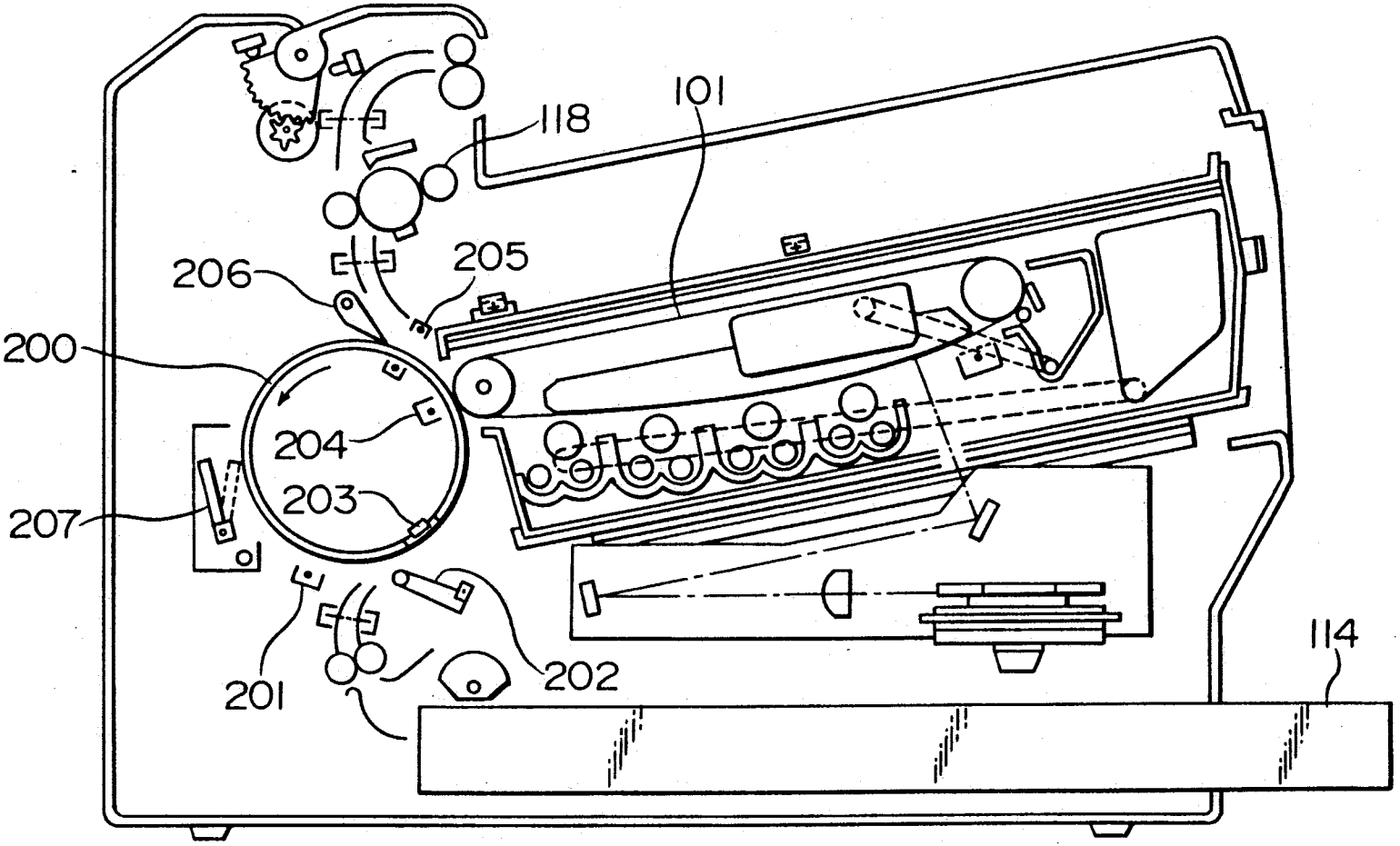
FIG. 9 is a sectional view showing the structure of the second embodiment of the image forming apparatus.

The first embodiment of the image forming apparatus of the present invention is shown in FIG. 1 to FIGS. 8*a*–8*b*, and the second embodiment is shown in FIG. 9.

Figure 1:
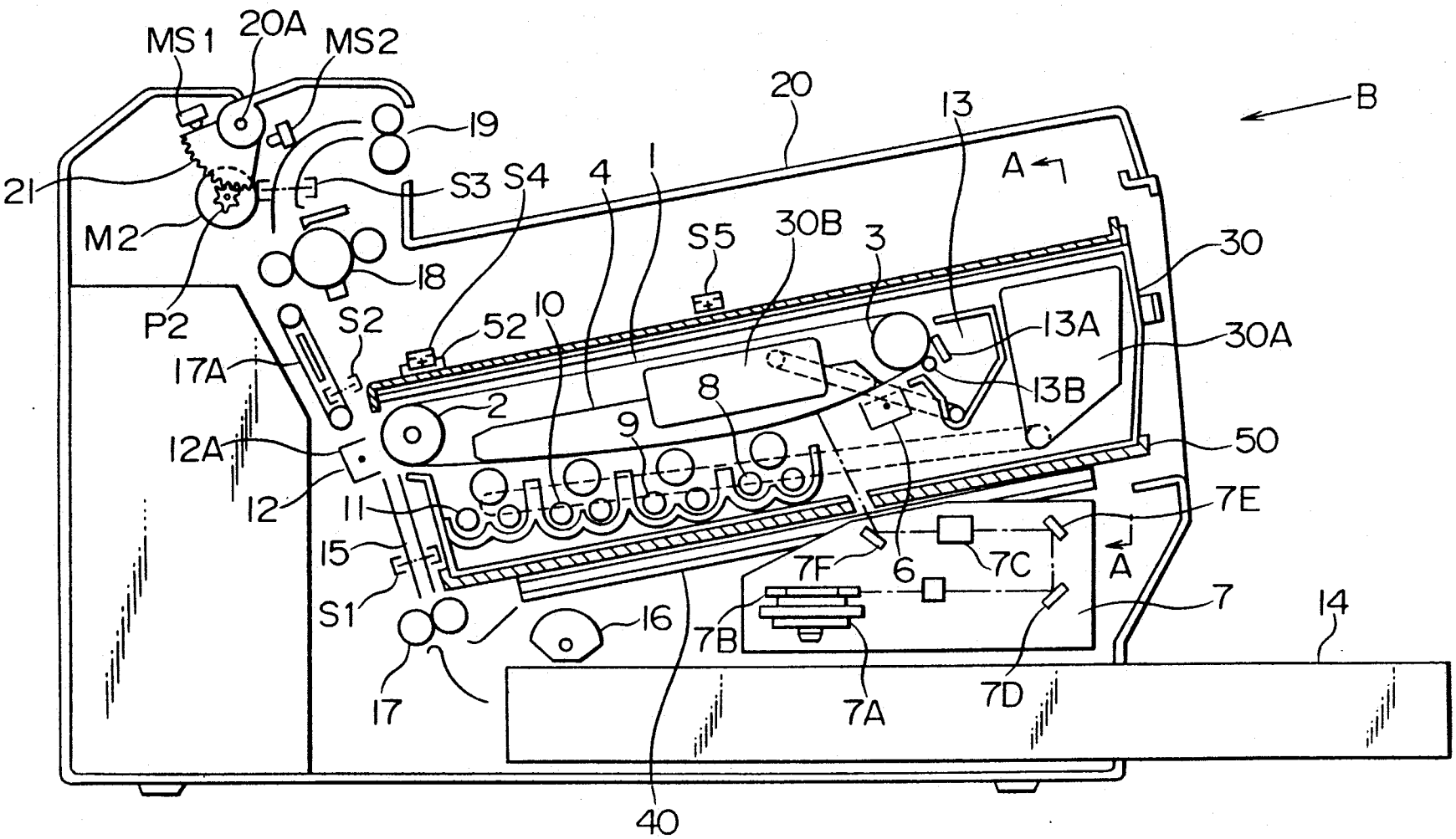
FIG. 1 and FIG. 2 are sectional views showing the structure of the first embodiment of the image forming apparatus of the present invention.

In FIG. 1, numeral 1 indicates a flexible photosensitive belt which is a belt type of image carrying member. The photosensitive belt 1 is provided around rotating rollers 2 and 3 rotated clockwise by the drive of the rotating roller 2.

Numeral 4 indicates a guide member which is fixed to the apparatus body so that it supports internally the photosensitive belt 1. Since the photosensitive belt 1 is stretched by the outward forcing action of tension roller 3, the inner surface of the belt slides along the guide member 4.

Therefore, the photoconductor on the outer peripheral surface of the photosensitive belt 1 is kept at a constant distance from the surface of the guide member 4 during movement so as to configure a stable image forming surface.

Numeral 6 indicates a scorotron charging unit which is a charging means, numeral 7 is a laser writing system unit which is an image exposure means, and numeral 8 to numeral 11 are a plurality of developing means or developing units containing specific color developers. The aforementioned image forming means are provided facing the outer peripheral surface of the photosensitive belt 1, behind which the guide member 4 is installed.

In addition to the optical system shown in FIG. 1, an optical system, comprising a luminous unit and a convergent light transmitter which are integrated, may be used as a laser writer system unit 7.

The developing units 8, 9, 10 and 11 include, for example, yellow, magenta, cyan and black developers respectively and have developing sleeves which are at a predetermined distance from the photosensitive belt 1 so as to visualize latent images on the photosensitive belt 1 by the non-contact type of developing method. This non-contact type of developing method has an advantage that the movement of the photosensitive belt is not disturbed, unlike the contact type of developing method.

Numeral 12 is a transfer unit, numeral 12A is a discharging bar, and numeral 13 is a cleaning unit. A blade 13A of the cleaning unit 13 and a toner feed roller 13B are kept away from the surface of the photosensitive belt 1 during image formation, and pressed onto the surface of the photosensitive belt 1 as shown in FIG. 1 only when the surface is cleaned after transfer.

The color image forming process performed by the aforementioned color image forming apparatus is discussed below.

First, a multi-color image is formed by an image forming system indicated below in this embodiment. Data obtained by a color image data input unit, wherein an original image is scanned by image pick-up elements, is processed by an image data processing unit so as to create image data, and then the obtained image data is stored in an image memory. The image data is retrieved for recording and inputted to a recording unit, for example, the color image forming apparatus shown in the embodiment in FIG. 1.

When a color signal outputted from an image reader, which is different from the aforementioned printer, is inputted to the laser writing system unit 7, a laser beam generated by a semiconductor laser (not shown in FIG. 1) is rotationally scanned by a polygonal mirror 7B which is rotated by a drive motor 7A in the laser writing system unit 7. The laser beam is then reflected by mirrors 7D, 7E and 7F via an $f\theta$ lens 7C, and irradiated onto the peripheral surface of the photosensitive belt 1, which is charged beforehand by the charging unit 6 which is a charging means, so as to form a bright line.

When scanning starts, the beam is detected by an index sensor, the beam corresponding to the first color signal starts modulation, and the modulated beam scans on the peripheral surface of the photosensitive belt 1. Therefore, a latent image corresponding to the first color is formed on the peripheral surface of the photosensitive belt 1 by the primary scanning of the laser beam and by the secondary scanning by the movement of the photosensitive belt 1. This latent image is developed by the developing unit 8 of the developing means containing yellow (Y) toner (a developing medium) and a toner image is formed on the belt surface. The toner image formed on the belt surface passes under the cleaning unit 13 (a cleaning, which is positioned away from the peripheral surface of the photosensitive belt 1 and enters the next copy cycle.

The photosensitive belt 1 is charged by the charging 6 once again, the second color signal outputted from the signal processing unit is inputted to the writing system unit 7, and data is written on the belt surface in the same way as that of the first color signal so as to form a latent image. The latent image is developed by the developing unit 9 containing magenta (M) toner as the second color.

This magenta (M) toner image is formed under the condition that the aforementioned yellow (Y) toner image, which has been already formed, exists.

Numeral 10 indicates a developing unit containing cyan (C) toner, which forms a cyan (C) toner image on the drum surface according to a control signal generated by the signal processing unit in the same manner discussed above.

Numeral 11 indicates a developing unit containing black toner, which superimposes a black toner image on the belt surface by the same processing method. A DC or AC bias voltage is applied to each sleeve of the developing units 8, 9, 10 and 11. As such, development is performed by a 2-component developer which is a developing means, and non-contact type of development is performed on the photosensitive belt 1, the base of which is grounded. Non-contact type of development using a single-component developer may also be performed.

Color toner images formed on the peripheral surface of the photosensitive belt 1 are transferred onto a transfer sheet, which is sent from a paper feed cassette 14 via a paper feed guide 15, at the transfer unit.

The top transfer sheet contained in the paper feed cassette 14 is conveyed by the rotation of a paper feed roller 16 and fed to the transfer unit 12 via timing rollers 17 in relation to the timing of image forming on the photosensitive belt 1.

The transfer sheet, which has a transferred image and is discharged, separates surely from the photosensitive belt 1 which changes direction suddenly around the rotating roller 2. The transfer sheet moves up via a suction conveyor belt 17A. The image is melted and fixed by fixing rollers 18 and then the transfer sheet is ejected onto a tray formed on an upper lid 20 via paper ejection rollers 19.

The photosensitive belt 1, after transfer onto the transfer sheet has been completed, continues to move, and remaining toner is removed by the cleaning unit 13 wherein the blade 13A and the toner cleaning roller 13B are pressed to the belt. Then, the blade 13A is separated from the belt once again, the toner cleaning roller 13B smooths toner accumulated on the tip of the blade 13A, the toner cleaning roller 13B is separated from the belt, and the apparatus enters a new image forming process.

The photosensitive belt 1, charging unit 6, developing units, and cleaning unit 13 are incorporated and integrated into an independent process cartridge 30 as process components for image forming so as to be mounted or removed from the apparatus body.

Figure 3:
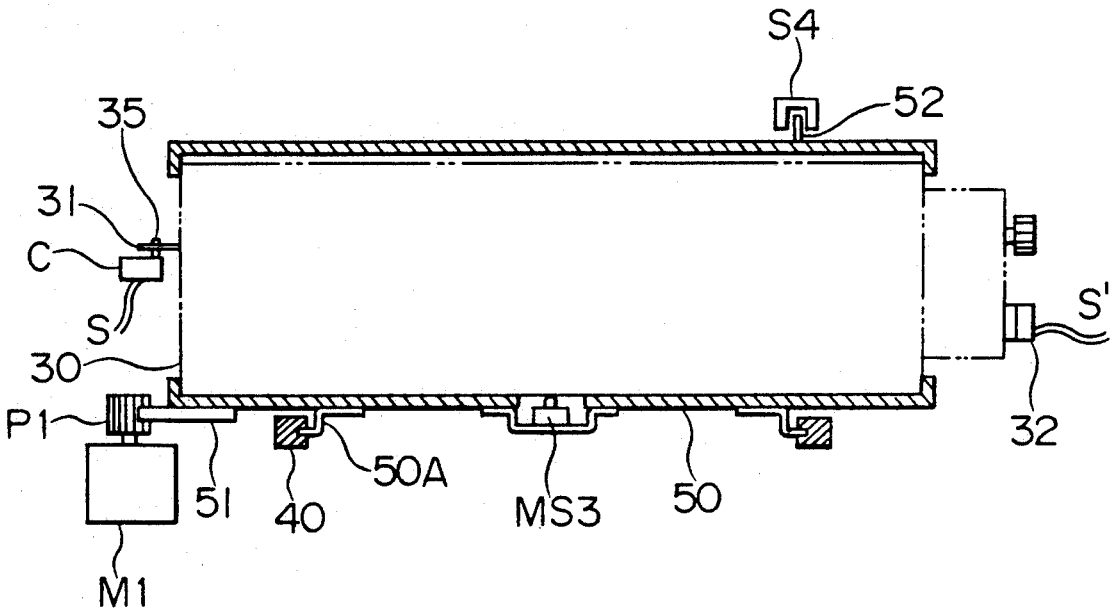
FIGS. 3, 4(*a*), 4(*b*) and 5 are sectional views of the main portion.

In the apparatus, as shown in FIG. 3, showing the section AA, a frame 50 has legs 50A at the bottom thereof. The legs 50A are engaged with a pair of fixed guide rails 40 such that the frame 50 is slidably supported, and the process cartridge 30 is mounted on the frame 50.

Figure 2:
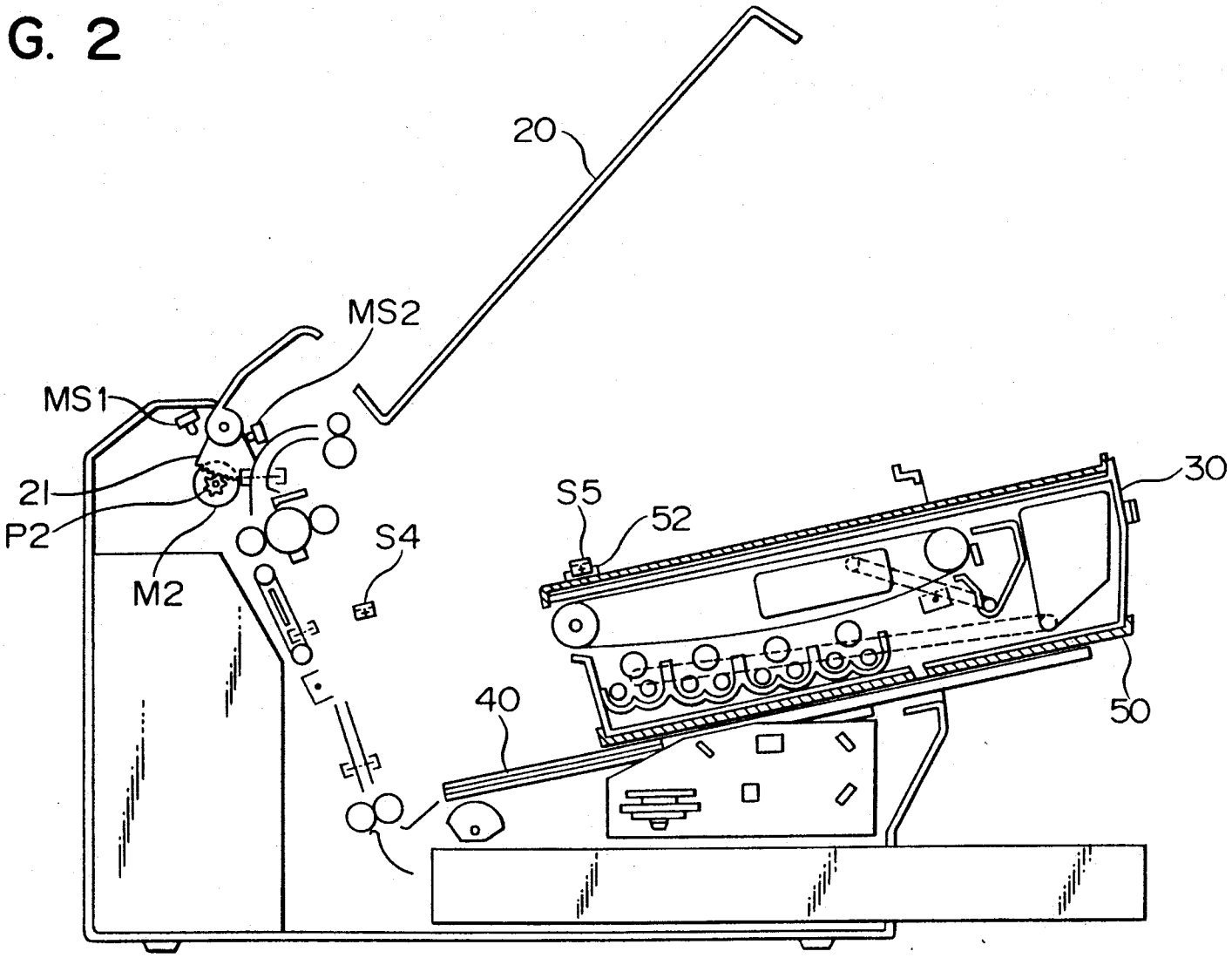

The frame 50 has a rack plate 51 which is engaged with a pinion P1 of a motor M1 of the apparatus body. As such, the frame 50 and process cartridge 30 supported thereon moves up slantwise in parallel, as shown in FIG. 2, by the rotation of the motor M1 so as to protrude from the side of the apparatus body, and be held at a predetermined position.

The upper lid 20 is supported by the apparatus body via a shaft 20A so that it can rotate. When the upper lid rotates counterclockwise, it opens and the opening at the upper part of the apparatus body is uncovered.

The upper lid 20 has a sector gear 21 at the rotation base which is engaged with a pinion P2 of a motor M2 of the apparatus body. The upper lid and rotates counterclockwise, as shown in FIG. 2, by the rotation of the motor M2 and is held at a predetermined angle.

The movement of the frame 50 or the opening of the upper lid 20, that is, the rotation of the motor M1 or M2, starts automatically in synchronization with the cycle of replacement, checking, or replenishment of process supplies or an occurrence of transfer material feed trouble.

The process cartridge 30 has a counter function for adding up the frequency of use of process supplies. When a new process cartridge is mounted in the apparatus body, a protrusion 31 on the side of the cartridge shown in FIG. 3 presses a reset lever 35 of a counter C installed in the apparatus body so as to return the indication of the counter C to 0. The and the counter C records the frequency of use thereafter. When the durable use frequency of the blade 13A of the cleaning unit 13 or the durable use frequency of the belt reaches a predetermined reference value, the counter C outputs a signal S.

EXAMPLE

| | | | |
|---|---|---|---|
| Durable use frequency of blades: | 20000 | | |
| Durable use frequency of drum: | 60000 | | |
| Cleaning replacement signal: | 20000, 60000 | 40000 | Signal S is outputted. |
| Drum replacement signal: | 60000 | | |

When a new process unit is inserted at the time when the frequency of 60000 has been counted, the counter C is reset.

The cycle of replacement or checking of the photosensitive belt 1, charging unit 6, developing units, or cleaning unit 13 is detected by this signal.

The proposal indicated in Japanese Utility Model 8295/1990 by the inventor of this invention is applied to the aforementioned protrusion 31, and the counter C is prevented from being reset by the cartridge 30 once again.

The aforementioned process cartridge 30 is provided with a sensor to detect the amount for remaining toner in the toner supply hopper 30A and a sensor to detect the amount of collected toner in the used toner cartridge 30B. Therefore, when the time of replenishment or replacement has come, signal S' is transmitted from the sensor to the apparatus body through the connector 32, so that the time can be detected.

Figure 6:
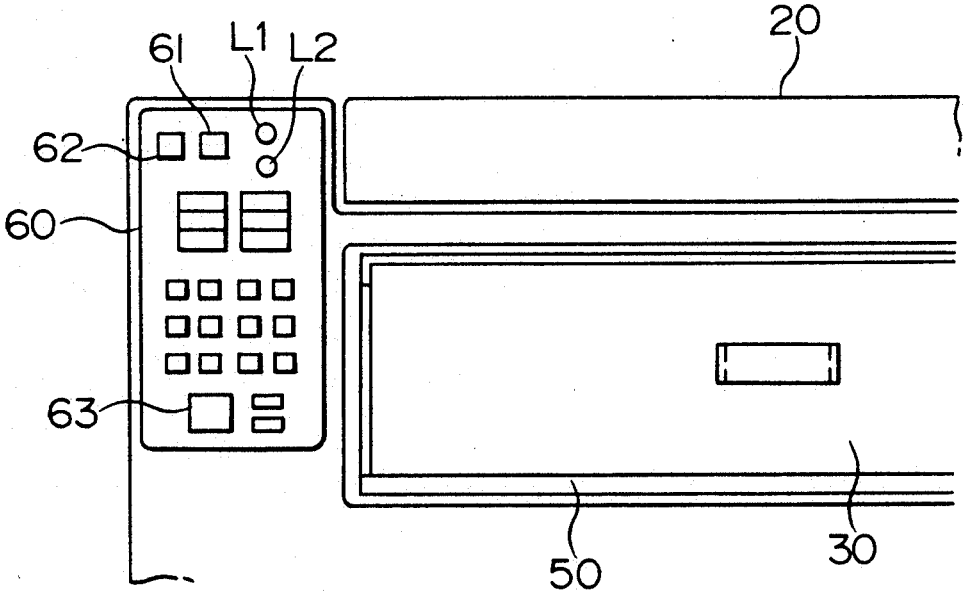
FIG. 6 is an enlarged side view of part of the main portion.

At the time of replacement in the maintenance cycle or replenishment or replacement of expendable supplies, a replacement indication is indicated on an operating indication unit 60 upon receipt of the signal S or S', as seen in FIG. 6.

Photosensors S1, S2 and S3 for detecting passing of a transfer sheet are installed at important locations on the transfer sheet feed path. When a sensor located on the downstream side of each feed path does not detect a transfer sheet within a predetermined time (in seconds) after a sensor located on the upstream side detects passing of the transfer sheet, a jam detection signal S'' (not shown in the drawing) is outputted and a jam occurrence of the transfer sheet is detected. Each detection signal is inputted to the control unit of the apparatus body and outputted as a signal for controlling the rotation of motor M1 or M2. A jam indicator lamp L1 of the operating indication unit 60 is lit.

Referring now to a control circuit diagram in FIG. 7 and flow charts in FIGS. 8(*a*) and 8(*b*), the rotation control process of motors M1 and M2 will be explained as follows.

The operating indication unit 60 of the apparatus installed on the front of the apparatus or on the side indicated by an arrow B shown in FIG. 1 comprises, as shown in FIG. 6, a lamp L1 for indicating a jam occurrence of a transfer sheet, a lamp L2 for indicating replacement of process supplies, a reset button 61 for starting to drive motor M1 or M2 in the reverse direction, and an eject button 62 for starting to drive motor M1 or M2 in the forward direction.

When the jam detection signal (S'') or the signal (S or S') for detecting replacement of process supplies or for detecting replenishment of developers is inputted to the control unit of the apparatus body, the lamp L1 or L2 is lit for indication.

When one of the detection signals is inputted, a signal is outputted to the power source section synchronously with lighting so that electric power is supplied to rotate the aforementioned motor M1 and M2 in the forward direction.

As illustrated in FIG. 7, when one of the aforementioned signals is inputted into the control section of the apparatus, a signal to command the supply of electric power is outputted to the aforementioned motors M1 and M2 so that the motors can be rotated in the forward direction.

When the aforementioned motor M1 is rotated in the forward direction, the aforementioned frame 50 is moved from the position shown in FIG. 1 to the position shown in FIG. 2, and the rotation of the aforementioned motor M1 is stopped at the position where a light shield plate 52 changes over photo-sensor S5 of the apparatus from ON to OFF.

As a result, the process cartridge 30 is moved from the first position where images can be formed, to the second position where the process cartridge can be attached to and detached from the apparatus, so that the process cartridge 30 can be easily dismounted from the frame 50 and the process supplies can be effectively replaced, inspected or replenished.

In the image forming apparatus of the present invention, when the process cartridge 30 is moved from the first to the second position, the peripheral surface of the photosensitive belt 1 facing the transfer section is automatically covered so that it can be protected.

Figure 4:
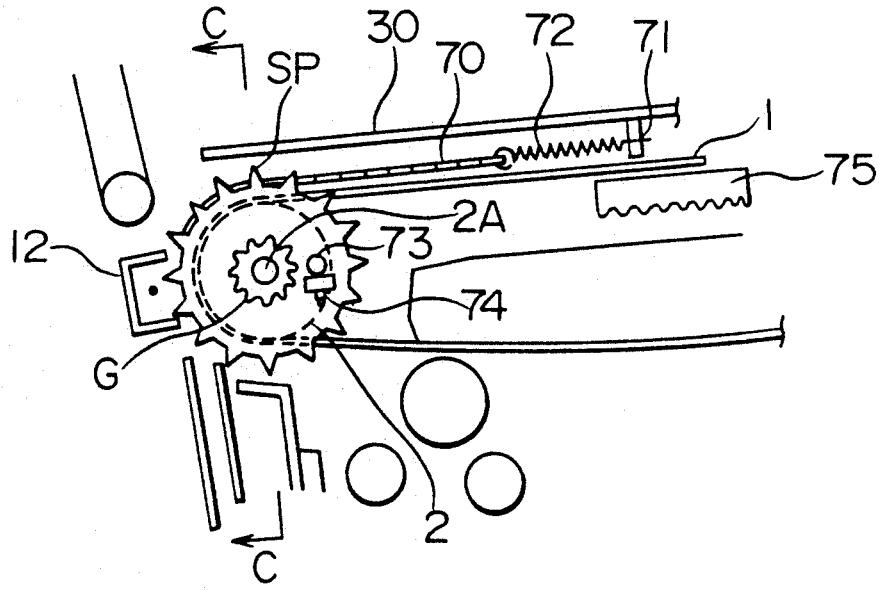
Figure 4:
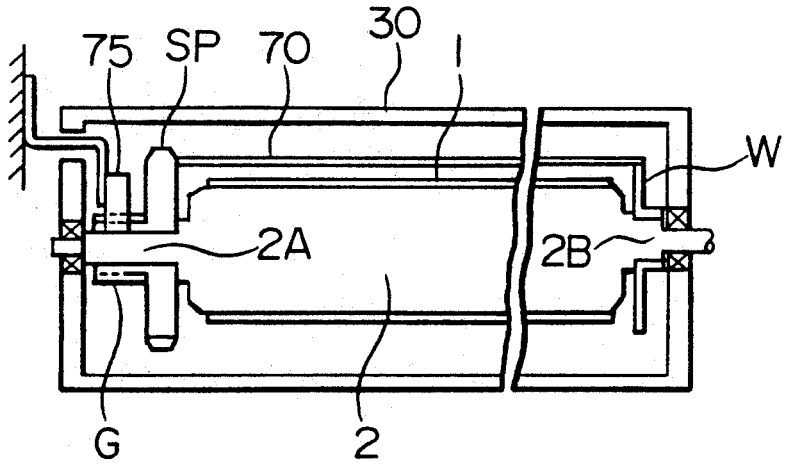

FIG. 4(*a*) shows a shaft end portion of the aforementioned rotating roller 2, and FIG. 4(*b*) shows a sectional view taken on line C—C in FIG. 4(*a*). A sprocket SP integrally formed with a spur gear G, is provided in a shaft end portion 2A on the front side of the aforementioned rotating roller 2. A guide wheel W is rotatably provided in a shaft end portion 2B on the other side.

The aforementioned sprocket SP meshes with a protective cover 70 made of a flexible thin metallic plate (for example, a phosphor bronze plate) having perforations on the edge on the front side, and the other side of the protective cover 70 is supported by the aforementioned guide wheel W.

Accordingly, the aforementioned protective cover 70 is maintained in parallel with the surface of the photosensitive belt 1 in such a manner that it covers the peripheral surface of the photosensitive belt 1, leaving a constant gap.

A tension spring 72 is stretched between the aforementioned protective cover 70 and a pin 71 mounted on the process cartridge 30, and when the process cartridge 30 is located in the aforementioned first position, the aforementioned sprocket SP is rotated clockwise by the force of the aforementioned tension spring 72, so that a stop pin 73 mounted on sprocket SP comes into contact with a protrusion 74 provided inside the process cartridge 30 to stop the rotation of sprocket SP.

Consequently, when the process cartridge 30 is located in the first position, the aforementioned protective cover 70 is withdrawn from the peripheral surface of the photosensitive belt 1, so that toner images can be transferred by the transfer unit 12.

Figure 5:
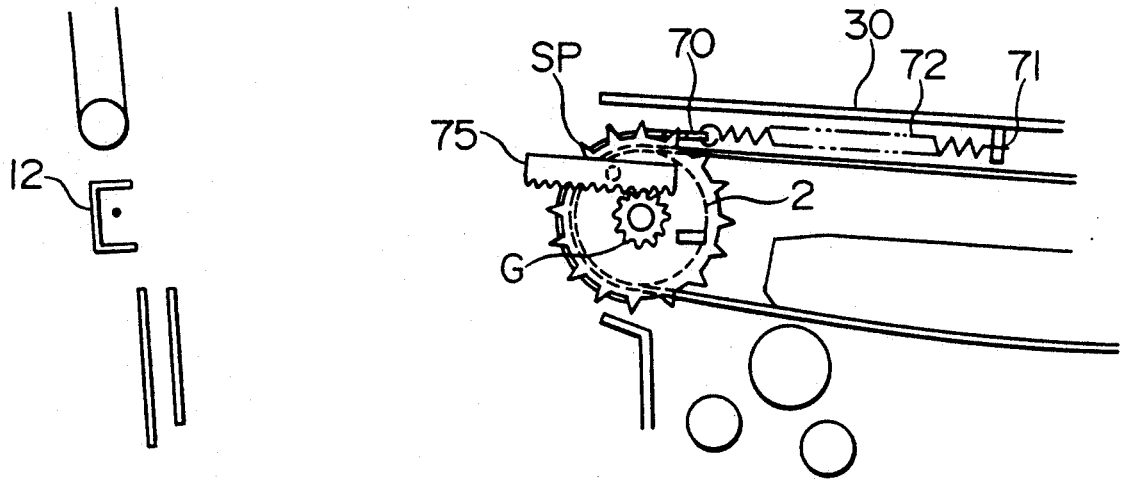

Next, when the process cartridge 30 is moved from the aforementioned first position to the second position, the aforementioned spur gear G meshes with a rack 75 fixed to the apparatus, so that sprocket SP is rotated counterclockwise. Therefore, as illustrated in FIG. 5, the aforementioned protective cover 70 covers a portion of the photosensitive belt 1 facing the transfer section, resisting the tension of the tension spring 72.

After this processing or simultaneously with this processing, motor M2 rotates forward, the upper lid 20 rotates from the angle shown in FIG. 1 to the angle shown in FIG. 2 so as to open the opening of the apparatus body, and motor M2 stops rotation at the angle at which the sector gear 21 presses switch MS2 of the apparatus body so as to change the switch from OFF to ON.

Therefore, a transfer sheet jam can be easily cleared, being combined with the movement of the process cartridge 30. Further, light degradation, stain and damage of the photosensitive belt can be prevented by the present invention.

When the process cartridge 30, which is removed from the frame 50 for replacing or replenishing process supplies, is mounted on the frame 50 once again as shown in FIG. 8(*a*), the bottom of the cartridge 30 presses switch MS3 so as to change the switch from OFF to ON, a signal for detecting existence of the process cartridge 30 is inputted, and signals for supplying reverse rotating power to motors M1 and M2 are outputted.

As a result, the process cartridge 30 moves from the second position to the first position once again, motor M1 stops rotation at the position where the light shield plate 52 changes the photosensor S4 of the apparatus body from OFF to ON, and each process supply is maintained in the state in which images can be formed.

The process cartridge 30 is returned to the second position as follows: In the condition shown in FIG. 5, the aforementioned spur gear G is rotated clockwise, and then spur gear G is released from the rack 75. Accordingly, the aforementioned protective cover 70 rotates sprocket SP clockwise by the tension of the tension spring 72, so that a portion of the peripheral surface of the photosensitive belt 1 facing the transfer section is opened again as illustrated in FIG. 4(*a*).

By the reverse rotation of motor M2, the upper lid 20 rotates clockwise and stops rotation at the angle where the sector gear 21 changes switch MS1 from OFF to ON, the opening on the top of the apparatus body is closed, and the apparatus becomes ready for copying.

When a transfer material jam is cleared with the process cartridge 30 mounted on the frame 50, by pressing the reset button 61 of the operating indicating unit 60 as shown in FIG. 6, the action of switch MS3 is selected and signals for supplying reverse rotating power to motor M1 and M2 are outputted.

Jam indication lamp L1 or replacement/replenishment indication lamp L2 automatically turns off when the process cartridge returns to the first position or the upper lid 20 closes.

It is possible to install an ejection button 62 in the operation indicating unit 60 to rotate motors M1 and M2 forward for replacing process supplies due to exhaustion. Furthermore, it is possible to press the reset button 61 before or after the process cartridge 30 is installed so as to start motors M1 and M2 to rotate reversely in optional timing, in consideration of the safety of the operator for automatic opening and closing.

After lamp L1 or L2 is checked to be on, movement of the process cartridge 30 or opening or closing of the upper lid can be performed by operating the button. Therefore, the mechanism is simplified and the operation is guaranteed to be safe.

FIG. 9 shows a transfer drum type of image forming apparatus as the second embodiment of the present invention. A photosensitive belt 101 and a process cartridge mounted around it are almost the same as those used in the previous embodiment, except the a transfer drum 200 is mounted in contact with a transfer part of the photosensitive belt and rotates in synchronization with the photosensitive belt 101 in the direction of the arrow (counterclockwise). A transfer sheet is wound round the outer periphery of the transfer drum 200, a toner image is transferred onto the wound transfer sheet, and the transferred toner image is superimposed. The transfer sheet is separated from the transfer drum 200 and ejected from the apparatus after fixing.

A charging unit 201 for electrostatically attracting a transfer sheet and a winding unit 202 for mechanically winding a transfer sheet round the transfer drum 200 are installed around the transfer drum 200. The winding unit 202 has a roller at the head thereof and the roller touches the transfer drum 200 only at the start of winding a transfer sheet round the transfer drum. A gripper 203 is mounted on the peripheral surface of the transfer drum 200 so as to hold the leading edge of a transfer sheet fed in synchronization. Numeral 204 indicates a transfer unit which electrostatically transfers a toner image on the photosensitive belt 101 onto a transfer sheet. Numeral 205 indicates a separation discharging electrode and numeral 206 indicates a separation clutch pin. Numeral 207 indicates a cleaner which can contact with or separate from the transfer drum 200 and removes toner attached to the transfer drum 200 after a transfer sheet has been separated.

A transfer sheet ejected from a paper feed cassette 114 enters the transfer drum 200 which is charged by the charging unit 201 in a synchronized timing and is wound by the winding unit 202 and rotated toward the transfer part with the leading edge thereof hold with the gripper 203. At the transfer part, a yellow (Y) toner image, which is formed on the photosensitive belt 101 by the transfer unit 204, is transferred onto the transfer sheet. The transfer drum 200, which has finished the first transfer, continues rotation and superimposes a magenta (M) toner image at the second rotation, a cyan (C) toner image at the third rotation, and a black (BK) toner image at the fourth rotation, successively. When the four-color toner images are transferred, the transfer sheet is discharged by the separation discharging electrode 205, separated from the transfer drum after the leading edge of the transfer sheet is released by the separation clutch pin 206, and fed to a fixing roller 118.

The image forming apparatus of this embodiment is structured so that the transfer drum 200 is installed on the apparatus body side but not contained in a process cartridge which can be moved or removed. Therefore, the process cartridge can be inserted or removed, and a jam can be cleared in the same manner as in the previous embodiment.

Figure 10:
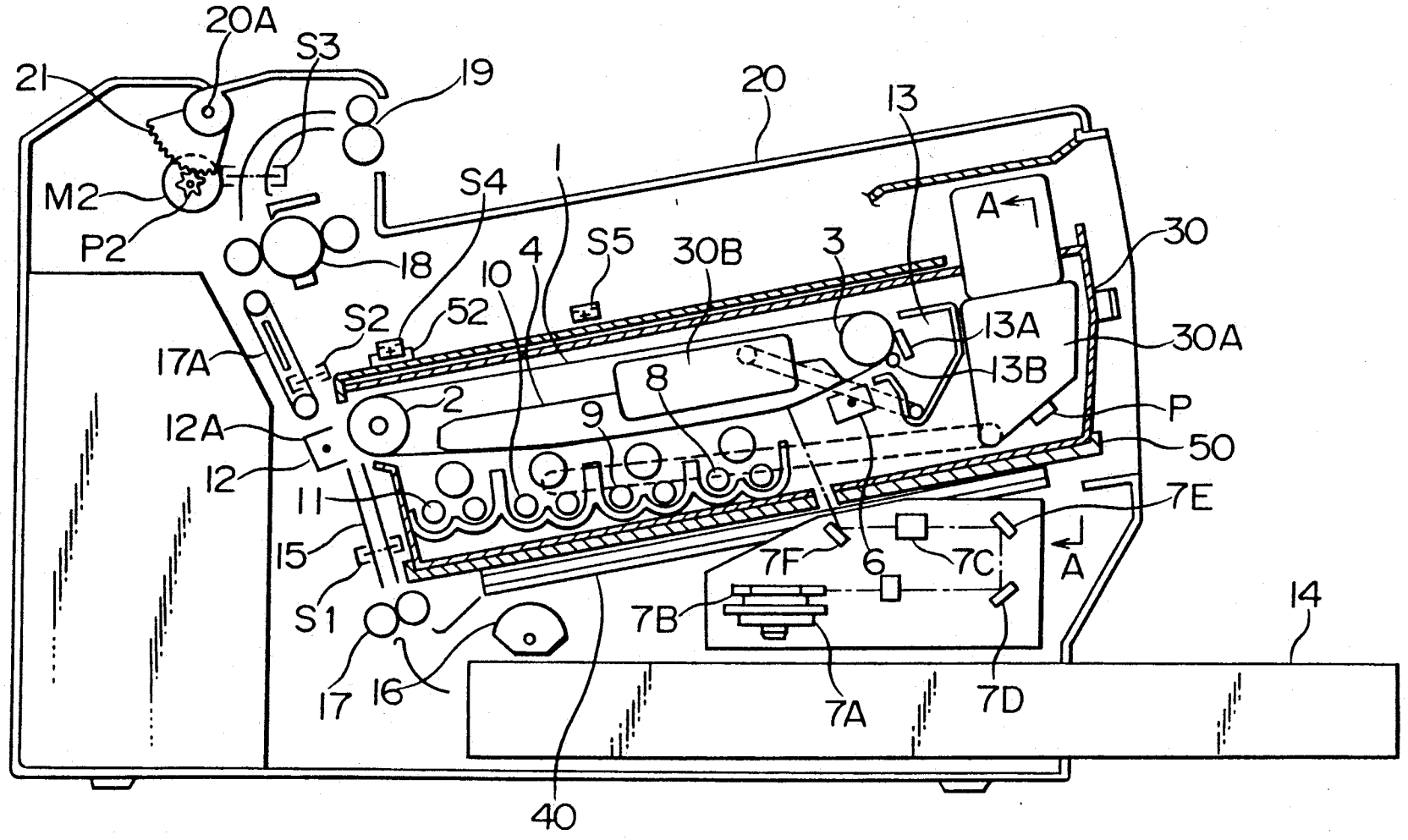
FIG. 10 is a sectional view showing the structures of the third, fourth and fifth embodiments of the present invention.

The third embodiment of the image forming apparatus of the present invention is shown in FIG. 10 to FIG. 14. FIG. 15 is a timing chart of the aforementioned process. The structure and operation of the apparatus shown in FIG. 10 is approximately the same as those shown in FIG. 1.

Figure 11:
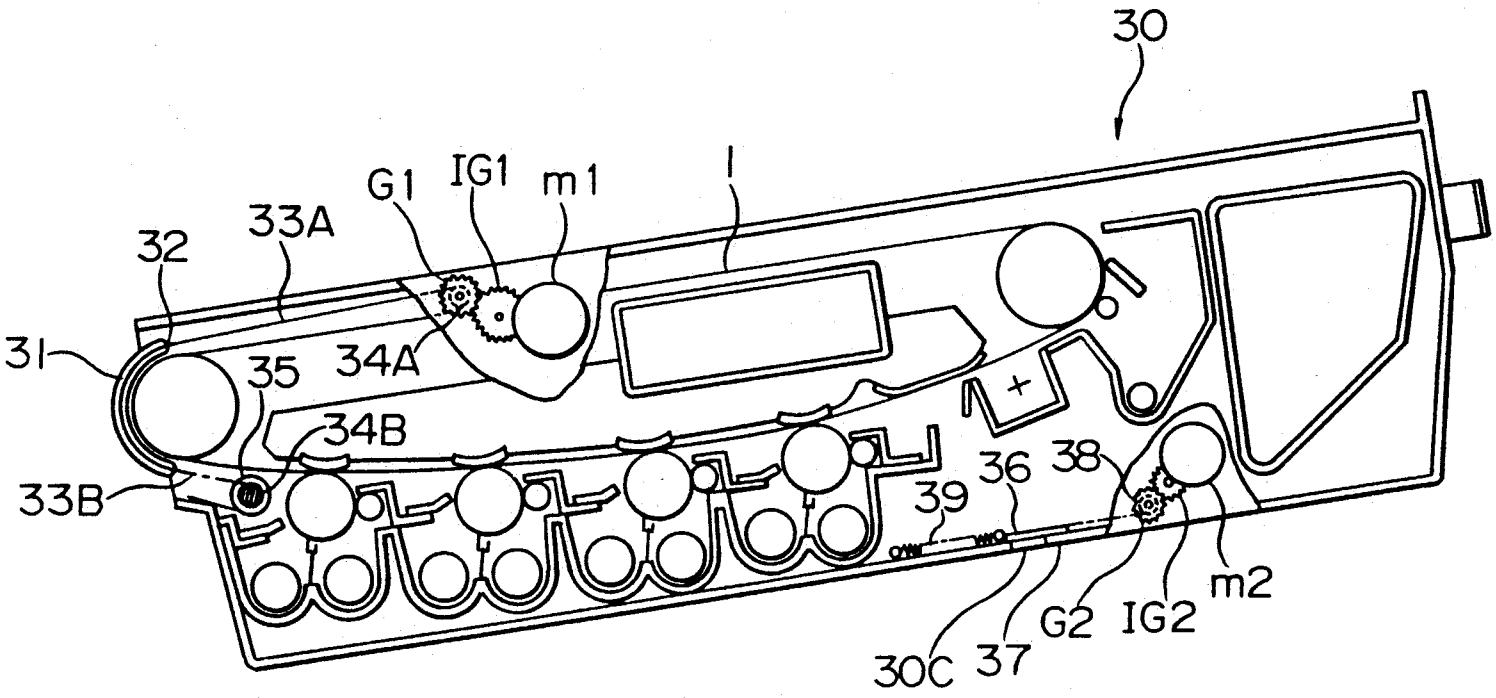
FIG. 11 is a sectional view showing the structure of the process cartridge of the third and fourth embodiments of the aforementioned apparatus.
Figure 12:
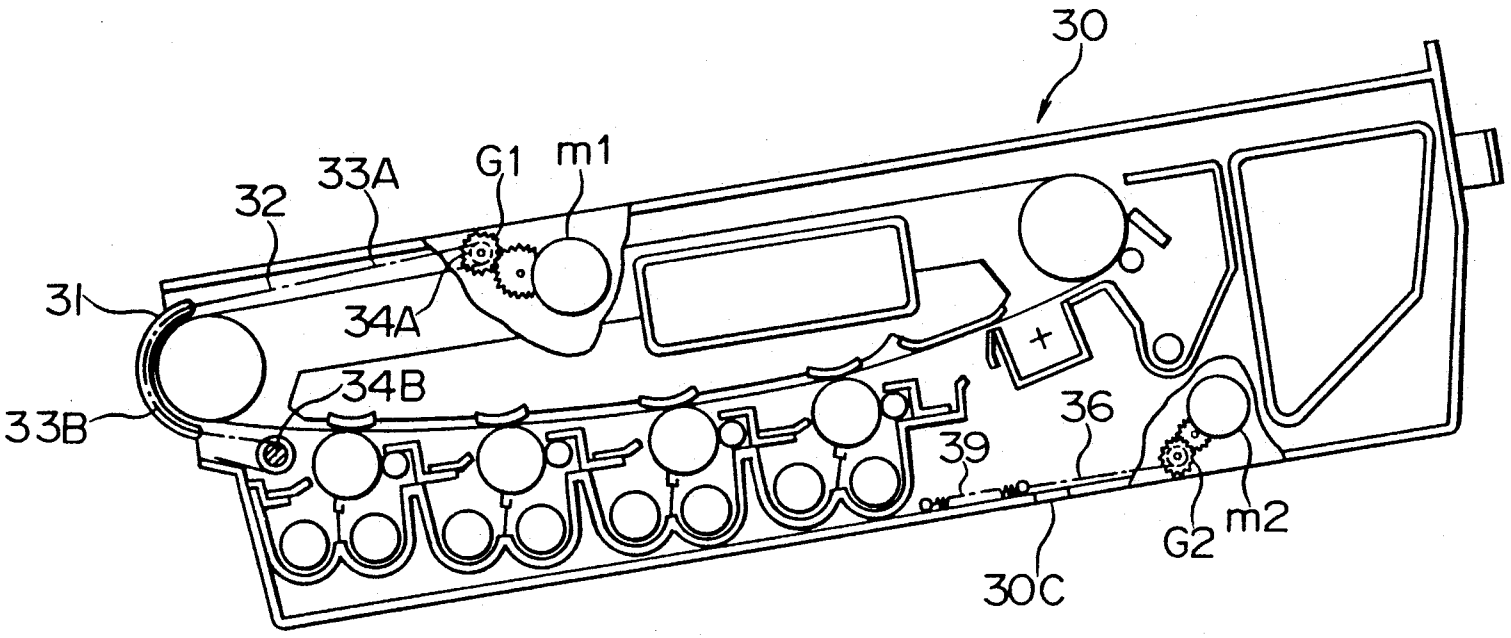
FIG. 12 is a sectional view showing the structure of the process cartridge of the third and fourth embodiments of the aforementioned apparatus.

The aforementioned photosensitive belt 1 is installed into an independent color process cartridge 30 shown in FIG. 11 and FIG. 12 together with a charging unit 6 and developing units which are disposed on the lower edge of the photosensitive belt, and together with a cleaning unit 13 disposed on the lateral edge of the photosensitive belt, and the photosensitive belt 1 is detachably provided to the apparatus body as illustrated in FIG. 10. The color process cartridge may not necessarily include all the process supplies described above, but it may integrally include at least the photosensitive belt 1 and the cleaning unit 13.

In the aforementioned color process cartridge 30, a developer supply section 30A is provided to the side of the cleaning unit 13 so that toner can be supplied to each developing unit, and a used toner cartridge 30B is integrally provided to the aforementioned guide member 4 so that used toner can be collected after it has been removed by the cleaning unit.

The aforementioned color process cartridge is attached to and detached from the apparatus as follows.

Figure 14:
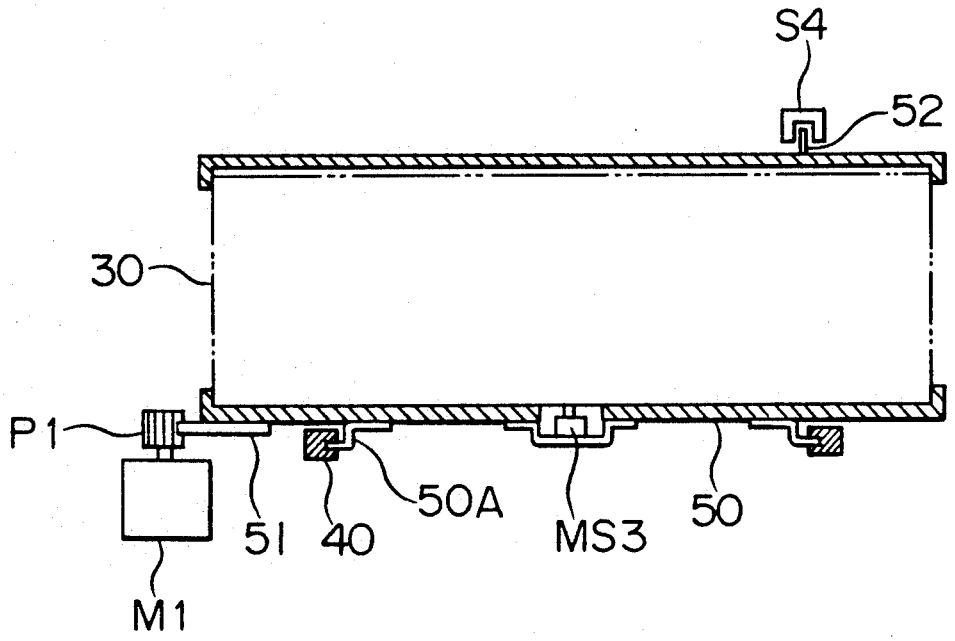
FIG. 14 is a sectional view showing the main portion of the third and fourth embodiments of the aforementioned apparatus.
Figure 15:
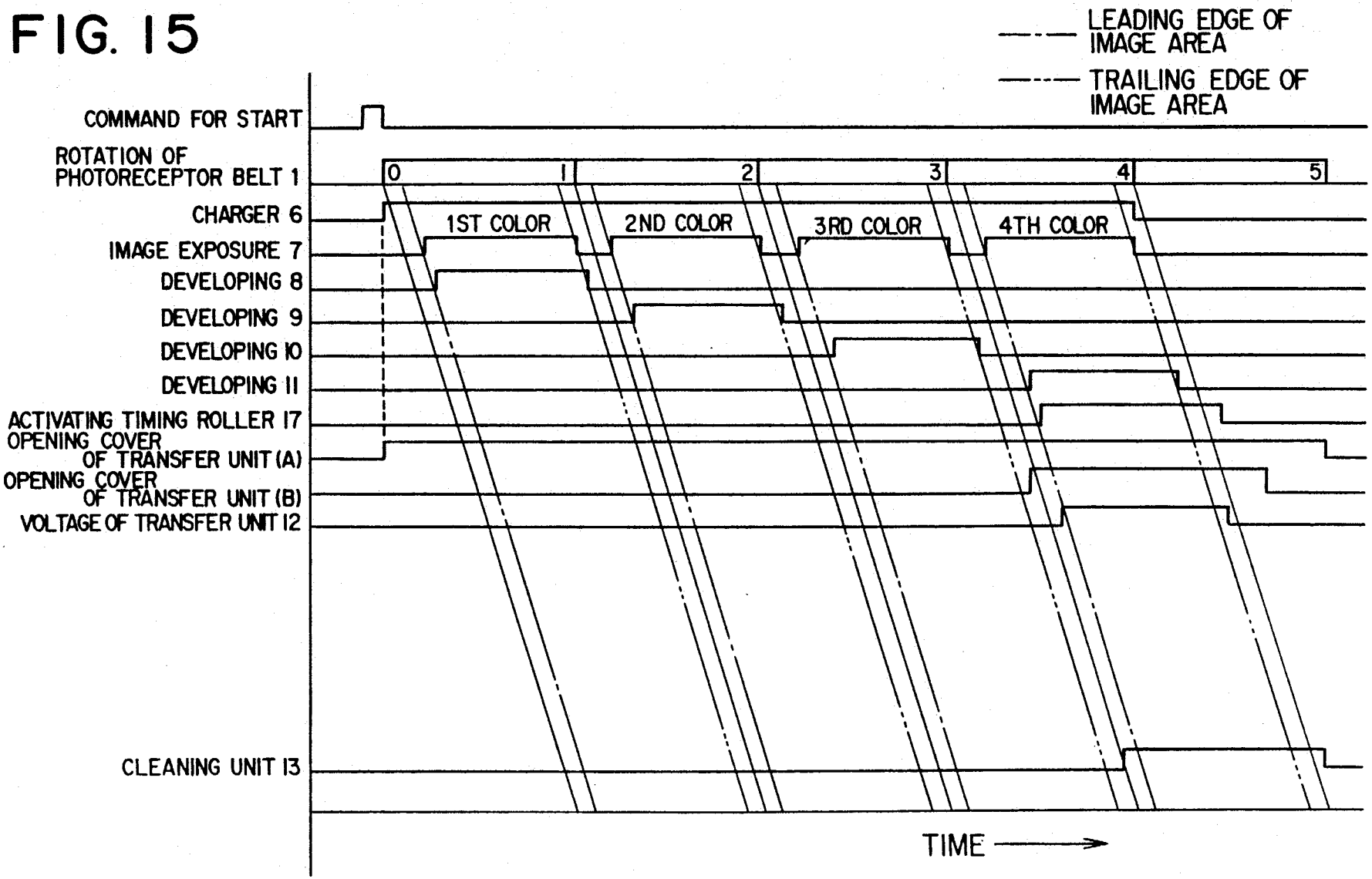
FIG. 15 is a timing chart showing the operation of the third embodiment of the present invention.

As illustrated in FIG. 14, which is a sectional view taken on line A—A in FIG. 10, a frame 50, includes a a leg portion 50A which is slidably engaged with a pair of fixed guide rails 40. The aforementioned color process cartridge 30 is installed inside the apparatus while the color process cartridge 30 is mounted on the aforementioned frame 50.

The aforementioned frame 50 is formed integrally with a rack 51 which meshes with pinion P1 of motor M1 provided on the apparatus side so that the frame 50 can be slid by the rotation of the aforementioned motor M1. The frame 50 is installed diagonally with regard to the apparatus as shown in FIG. 10.

As illustrated in FIG. 11, in the aforementioned process cartridge 30, a set of guide members 31 forming an arc-shaped slit are provided around the peripheral surface of the photosensitive belt 1 which faces the image transfer zone.

The aforementioned guide member 31 are located outside the image zone on both sides of the photosensitive belt 1, and a shielding member 32 covering the aforementioned image zone is provided along the photosensitive surface in the space formed by the guide member 31.

The aforementioned shielding member 32 is a flexible flat thin plate made of a resilient metallic plate. A pair of strings 33A, 33B (which are illustrated by a one-dotted line) are provided at both edges of the aforementioned light shielding member in such a manner that the strings **33*a*, 33*b* can be moved inside the slit formed by the aforementioned guide member 31**.

The other ends of the strings 33A, 33B are respectively connected to rotating shafts 34A, 34B provided in the color process cartridge 30. A gear G1 is coaxially mounted on the aforementioned rotating shaft 34A, such that gear G1 is connected with motor m1 having an electromagnetic clutch (not shown in the drawing), through an intermediate gear IG1.

On the other hand, the aforementioned rotating shaft 34B is rotated clockwise by a torsion spring 35 so that the string **33*b* is wound around the rotating shaft a plurality of times and the aforementioned shielding member 32 is maintained in a position where it closes the image transfer zone of the photosensitive belt 1**.

A plate-shaped shielding member 36 is slidably provided inside an opening 30C for exposure use in the aforementioned color process cartridge 30.

One edge of the aforementioned shielding member 36 is connected to one end of a string (shown by one-dotted line) 37, the other end of which is engaged with the rotating shaft 38. The other edge of the aforementioned shielding member 36 is connected with a pair of tension spring 39 which are provided outside the exposure zone and stretched between the shielding member 36 and the color process cartridge 30. The opening 30C of the aforementioned shielding member 36 is maintained to be closed by the force of the tension spring 39.

A gear G2 is coaxially mounted on the aforementioned rotating shaft 38. Gear G2 is connected to motor m2, which is provided with an electromagnetic clutch (not shown in the drawing), through an intermediate gear IG2.

The aforementioned motor m1 is operated in a predetermined period of time in an image forming process. For example, motor m1 is rotated in a period of time when the photosensitive belt 1 is operated.

That is, the operation is conducted as follows. When a copy switch installed in the operating section is operated, the photosensitive belt 1 starts rotation. Then, the aforementioned motor m1 starts, and at the same time, the electromagnetic clutch mounted on the rotating shaft of the motor is turned on. After the aforementioned gear G1 has been rotated clockwise by a predetermined number of revolutions, motor m1 is stopped automatically. (The aforementioned operation is shown by opening cover of transfer unit (A) in the timing chart shown in FIG. 15.)

As a result, the aforementioned string 33A is wound by the rotating shaft 34A, resisting the force of the torsion spring 35, and as illustrated in FIG. 12, the aforementioned shielding member 32 is withdrawn from the image transfer zone of the photosensitive belt 1, so that images can be transferred onto a transfer sheet.

When a series of copying operations have been completed and the rotation of the photosensitive belt 1 has been stopped, the electromagnetic clutch mounted on the rotating shaft of the aforementioned motor m1 is turned off, and the aforementioned rotating shaft 34A is released.

Accordingly, the aforementioned shielding member 32 located in a withdrawn position is connected with the rotating shaft 34B by the force of the torsion spring 35, and returned to the position shown in FIG. 11 so that the image transfer zone of the photosensitive belt 1 is again closed.

The aforementioned motor m1 and the electromagnetic clutch mounted on the rotating shaft of the motor may be operated only in the period of image transfer in which images are transferred onto a transfer sheet. (The aforementioned operation is shown by closing cover of transfer unit (B) in the timing chart shown in FIG. 15.)

That is, when the aforementioned timing roller 17 is rotated and the feeding operation of a transfer sheet, which is temporarily in a waiting condition, is started, the aforementioned motor m1 starts the rotation since the motor m1 is linked with the start of the operation of the aforementioned timing roller 17. At the same time, the electromagnetic clutch is turned on.

The aforementioned condition in which motor m1 is operated and the electromagnetic clutch is turned on, is continued for the period of time from the start of operation of the timing roller 17 to the passage of the trailing end of the maximum-sized transfer sheet. Motor m1 is then automatically stopped and the electromagnetic clutch is turned off so that the image transfer zone of the photosensitive belt 1 is closed again as shown in FIG. 11.

On the other hand, the aforementioned motor m2 is operated when the power switch is turned on, and at the same time, the electromagnetic clutch mounted on the rotating shaft is also turned on. In this manner, the aforementioned gear G2 is rotated counterclockwise by a predetermined number of revolutions, and then motor m2 is automatically stopped.

As a result, the aforementioned string 37 is wound around the rotating shaft 38, resisting the force of the tension spring 39. Prior to the time of image exposure, and as illustrated in FIG. 12, aforementioned shielding member 36 is withdrawn from the opening 30C for exposure use so that the aforementioned laser writing system unit 7 can conduct the exposure of document images.

Photosensors S1, S2 and S3 are disposed at key points of the transfer sheet passage. In the case where a sensor located on the downstream side can not detect a transfer sheet when a predetermined period of time has passed after a sensor located on the upstream side has detected a transfer sheet, a jam detection signal is outputted so that the occurrence of a jam can be detected.

The aforementioned detected signal is inputted into the control section of the apparatus and outputted as a signal to control the rotation of the aforementioned motor M1 and motor M2 which will be described later.

When a jam detection signal is inputted, the aforementioned motor M1 is rotated reversely, and the color process cartridge 30 is moved from the first position in which image formation is conducted, to the second position in which jam clearance, toner replenishment, or toner replacement is conducted.

The aforementioned reverse rotation of motor M1 is stopped when a light shielding plate 52 provided on the upper surface of the cartridge is detected by photosensor S5.

The aforementioned upper lid 20 is rotatably supported by the apparatus body through the shaft 20A, and opened when it is rotated counterclockwise, so that the upper opening portion of the apparatus is opened.

That is, the rotating base portion of the aforementioned upper lid 20 is integrally provided with a sector gear 21 which meshes with pinion P2 of motor M2 provided on the apparatus side. Accordingly, when the aforementioned motor M2 is rotated, the upper lid 20 is rotated countereclockwise, as compared with the position illustrated in the drawing so that a predetermined angle can be maintained.

Under the condition described above, both shielding members 32 and 36 provided to the color process cartridge 30 are located in the closed position to protect the surface of the photosensitive belt 1, such that a jammed paper is removed and toner is replenished safely.

When a reset button provided in the control section is operated, the process cartridge 30 is returned to the first position.

Figure 13:
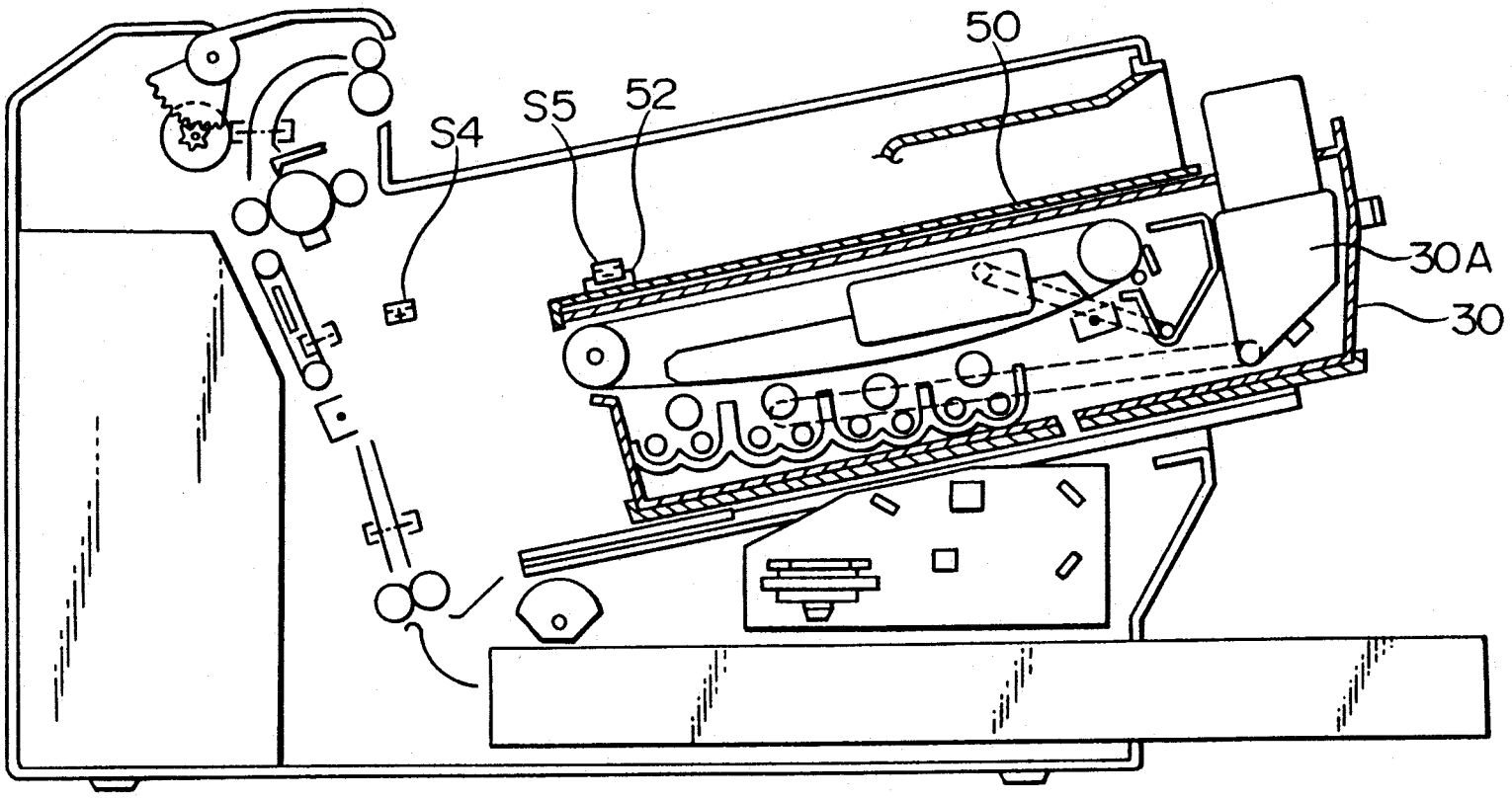
FIG. 13 is a sectional view showing the structure of the main portion of the third and fourth embodiments of the aforementioned apparatus.

When the reset button is pressed, the aforementioned motor M1 is normally rotated, and the color process cartridge 30 is moved from the position shown in FIG. 13 to the position shown in FIG. 10, and stopped at the position where the aforementioned light shielding plate 52 is detected by photosensor S4.

Synchronously with the aforementioned operation, the aforementioned motor M2 is also rotated forwardly, and the aforementioned upper lid 20 is rotated clockwise so that the upper opening portion of the apparatus can be opened.

Even when the color process cartridge 30 is dismounted from the apparatus, the aforementioned shielding members 32, 36 are maintained in the closed position in the same manner as the case in which the color process cartridge 30 is located in the second position.

The fourth embodiment of the image forming apparatus of the present invention is shown in FIG. 10 to FIG. 14.

In FIG. 11, the aforementioned motors m1 and m2 are operated in such a manner that when the power switch provided in the control section is turned on, or when an image forming signal is inputted, that is, the power switch is turned on and the copy switch is operated, motors m1 and m2 are operated. At the same time, the electromagnetic clutches mounted on the motor shafts are also turned on and the aforementioned gear G1 is rotated clockwise while the aforementioned gear G2 is rotated counterclockwise by a predetermined number of revolutions. After that, motors m1 and m2 are stopped automatically.

As a result, the aforementioned strings 33A and 37 are wound around the rotating shafts 34A and 38, resisting the force of the torsion spring 35 and the tension spring 39. Accordingly, the aforementioned shielding members 32 and 36 are withdrawn from the image transfer zone of the photosensitive belt 1 and the opening portion 30C respectively for exposure use. The document image exposure can then be conducted by the aforementioned laser writing system unit 7 and the image can be transferred onto the transfer sheet. The electromagnetic clutches mounted on motors m1 and m2 are turned off when the power switch is turned off or when a signal is inputted which represents the completion of a series of operation conducted by the copy switch. Consequently, the aforementioned rotating shafts 34*a* and 38 are released.

The shielding members 32, 36 located in the withdrawn position during the second position shown in FIG. 13, are respectively wound around the rotating shafts 34B, 38 by the force of the torsion spring 35 and the tension spring 39, so that they are returned to the position shown in FIG. 11 and close the image transfer zone of the photosensitive belt 1 and the opening 30C for exposure use.

Photosensors S1, S2 and S3 are disposed at key points of the transfer sheet passage. In the case where a sensor located on the downstream side can not detect a transfer sheet when a predetermined period of time has passed after a sensor located on the upstream side detected a transfer sheet, a jam detection signal is outputted so that the occurrence of a jam can be detected.

The aforementioned detected signal is inputted into the control section of the apparatus and outputted as a signal to control the rotation of the aforementioned motor M1 and motor M2, which will be described later.

When a jam detection signal is inputted, the aforementioned motor M1 is rotated reversely, and the color process cartridge 30 is moved from the first position in which image formation is conducted, to the second position shown in FIG. 13 in which jam clearance, toner replenishment, or toner replacement is conducted.

The aforementioned reverse rotation of motor M1 is stopped when a light shielding plate 52 provided on the upper surface of the cartridge is detected by photosensor S5.

The aforementioned upper lid 20 is rotatably supported by the apparatus body through the shaft 20A, and opened when it is rotated counterclockwise, so that the upper opening portion of the apparatus is opened.

That is, the rotating base portion of the aforementioned upper lid 20 is integrally provided with a sector gear 21 which meshes with pinion P2 of motor M2 provided on the apparatus side. Accordingly, when the aforementioned motor M2 is rotated, the upper lid 20 is rotated counterclockwise, as compared with the position illustrated in the drawing, so that a predetermined angle can be maintained.

Under the condition described above, both shielding members 32 and 36 provided on the color process cartridge 30 are located in the closed position to protect the surface of the photosensitive belt 1, and a jammed paper is removed and toner is replenished safely.

When a reset button provided in the control section is operated, the process cartridge 30 is returned to the first position.

When the reset button is pressed, the aforementioned motor M1 is forwardly rotated, and the color process cartridge 30 is moved from the position shown in FIG. 13 to the position shown in FIG. 10, and stopped at the position where the aforementioned light shielding plate 52 is detected by photosensor S4.

Synchronously with the aforementioned operation, the aforementioned motor M2 is also rotated forwardly, and the aforementioned upper lid 20 is rotated clockwise so that the upper opening portion of the apparatus can be closed.

Even when the color process cartridge 30 is dismounted from the apparatus, the aforementioned shielding members 32, 36 are maintained in the closed position in the same manner as the case in which the color process cartridge 30 is located in the second position.

The fifth embodiment of the image forming apparatus of the present invention is shown in FIG. 10, and FIG. 16 to FIG. 20.

Figure 16:
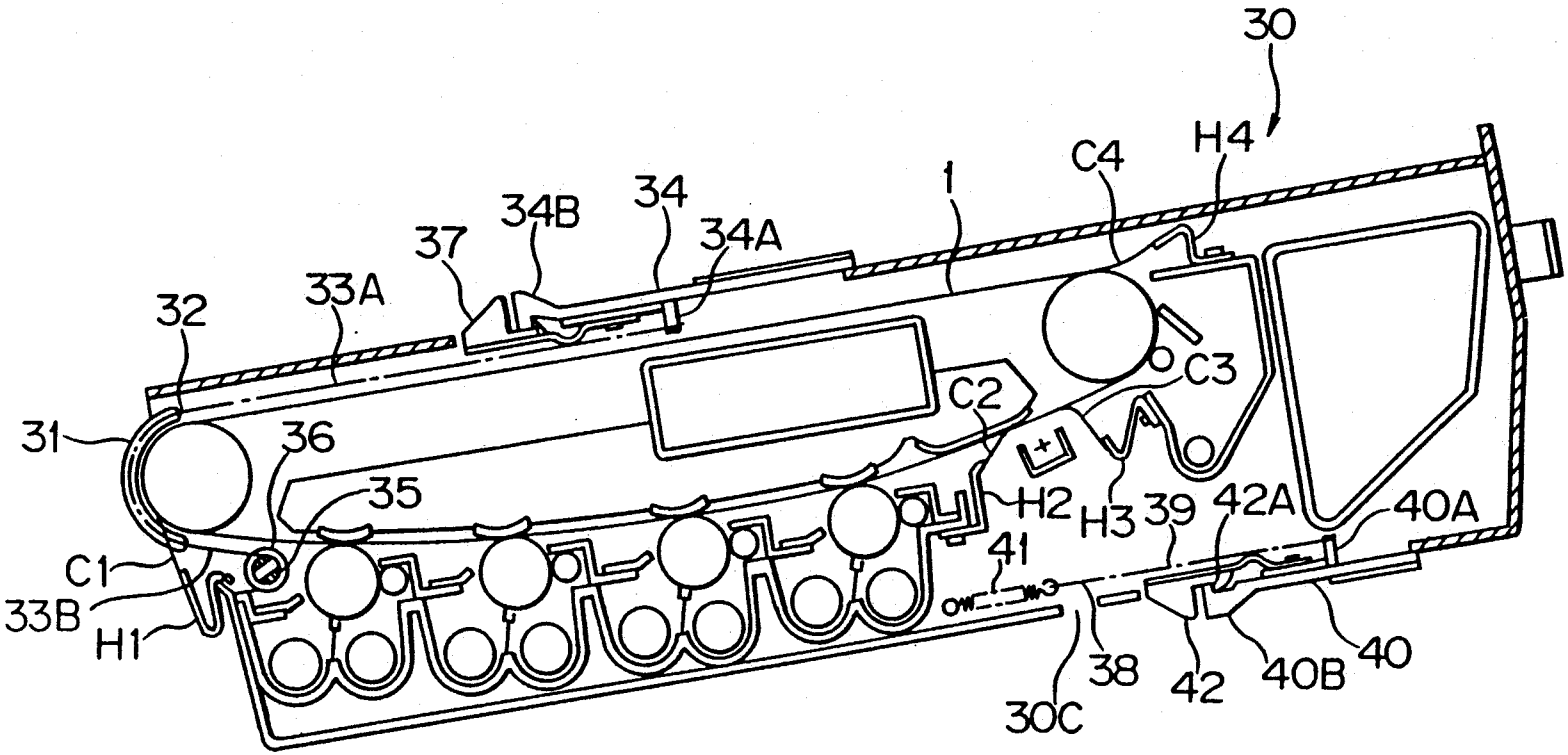
FIG. 16 is a sectional view showing the structure of the process cartridge of the fifth embodiment of the aforementioned apparatus.
Figure 17:
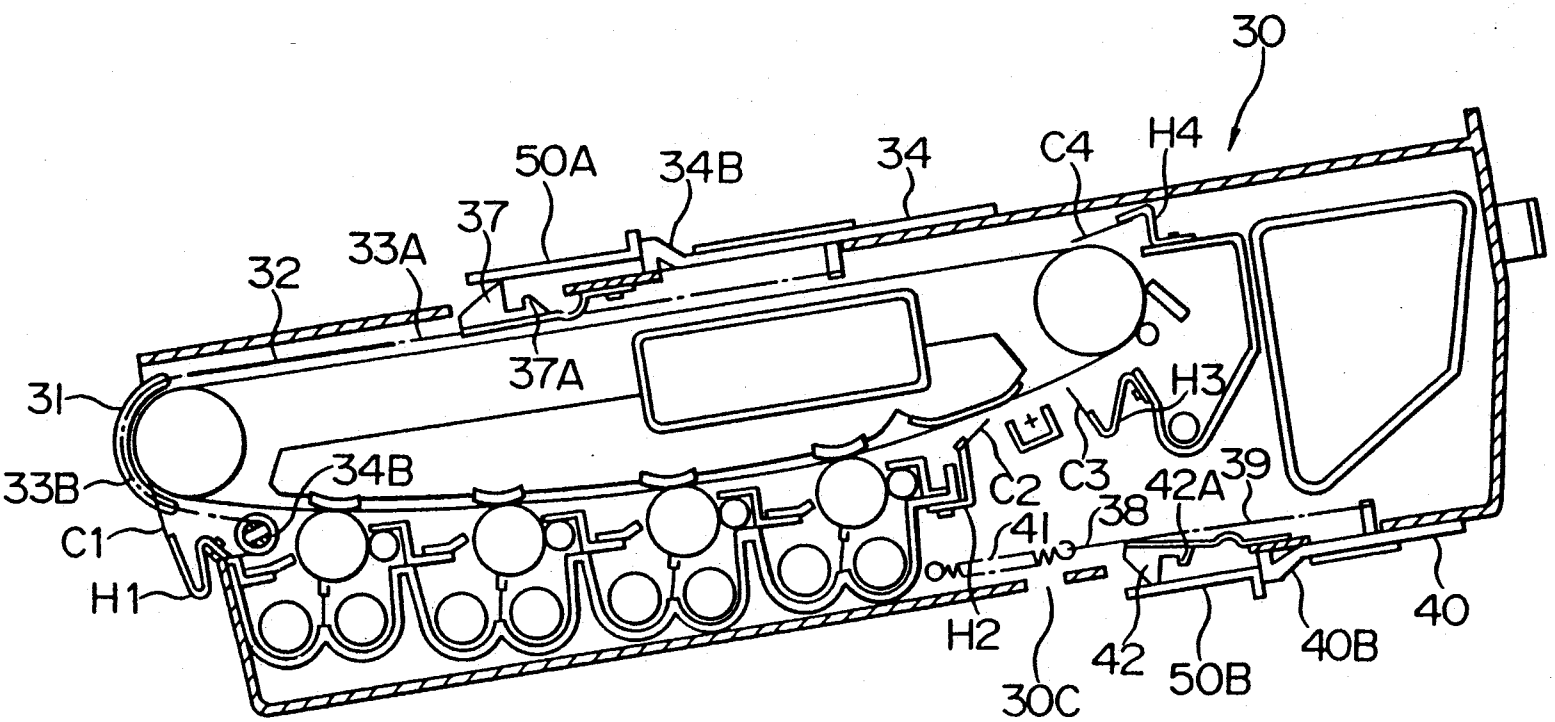
FIG. 17 is a sectional view showing the structure of the process cartridge of the fifth embodiment of the aforementioned apparatus.

In FIGS. 16, 17, one end of the aforementioned string 33A is fixed to a column 34A of a sliding plate 34 which is slidably supported on the upper surface of the cartridge 30. Likewise, one end of the aforementioned string 33B is fixed to and wound around the rotating shaft 35 which is always urged to be rotated clockwise by the force of the torsion spring 36 provided on the rotating shaft 35.

Consequently, when the process cartridge 30 is not located in a position where image formation is to be conducted, the aforementioned sliding plate 34 is slid to the left so that the column 34A comes into contact with the outer wall of the cartridge 30, and the aforementioned sliding plate 34 is engaged with a protrusion 37 of an engaging plate 37A under the condition that the shielding member 32 is located in the image transfer zone of the photosensitive belt 1.

In the aforementioned process cartridge 30, a plate-shaped shielding member 38 is slidably installed inside the opening 30C for exposure use.

One edge of the aforementioned shielding member 38 is connected with a pair of strings 39, and the strings 39 are fixed to a column 40A of a sliding plate 40 which is slidably supported on the lower surface of the cartridge 30.

The other end of the aforementioned shielding member 38 is connected with a pair of tension springs 41 outside the exposure zone, wherein the tension springs 41 are stretched between the shielding member 38 and the process cartridge 30.

Consequently, when the process cartridge 30 is not located in a position where image formation is to be conducted, the aforementioned sliding plate 40 is slid to the left so that the column 40A comes into contact with the outer wall of the cartridge 30, and the aforementioned sliding plate 40 is engaged with a protrusion 42A of an engaging plate 42 under the condition that the shielding member 38 is located in the position where the aforementioned opening 30C is closed.

In the aforementioned process cartridge 30, shielding plates C1, C2, C3 and C4, each end having one fixed to supporting plates H1, H2, H3 and H4, repeatively, are provided in a slit-shaped gaps formed between the developing units and the peripheral surface of the photosensitive belt 1, or between the cleaning unit 13 and the photosensitive belt 1.

The aforementioned shielding plates are made from a mild flexible synthetic resin such as Mylar, and the aforementioned support plates are made from a resilient metal such as phosphor bronze and stainless steel. The shielding plates are installed in such a manner that the tip of each shielding plate comes into contact with the peripheral surface of the photosensitive belt 1 with light pressure.

When the aforementioned process cartridge 30 is installed in the apparatus, the aforementioned engaging plates 37, 42 first come into contact with release plates 50A, 50B fixed in the apparatus.

When each release plate comes into contact with the engaging plate, the engaging plate is pushed inside and withdrawn, so that the aforementioned sliding plates 34, 40 are released. Accordingly, since each sliding plate is subsequently contacted with each release plate, each sliding plate 34, 40 is slid to the right. When the cartridge 30 is installed in the position where image formation is to be conducted, the sliding plates 34, 40 reach the position shown in FIG. 17.

As a result, the aforementioned shielding members 32, 38 are withdrawn from the image transfer zone of the photoreceptor 1 and the aforementioned opening portion 30C, wherein the shielding members 32, 38 resist the force of the torsion spring 36 and the tension spring 41. Consequently, the process cartridge 30 is readily set in the condition where image formation can be conducted.

Figure 18:
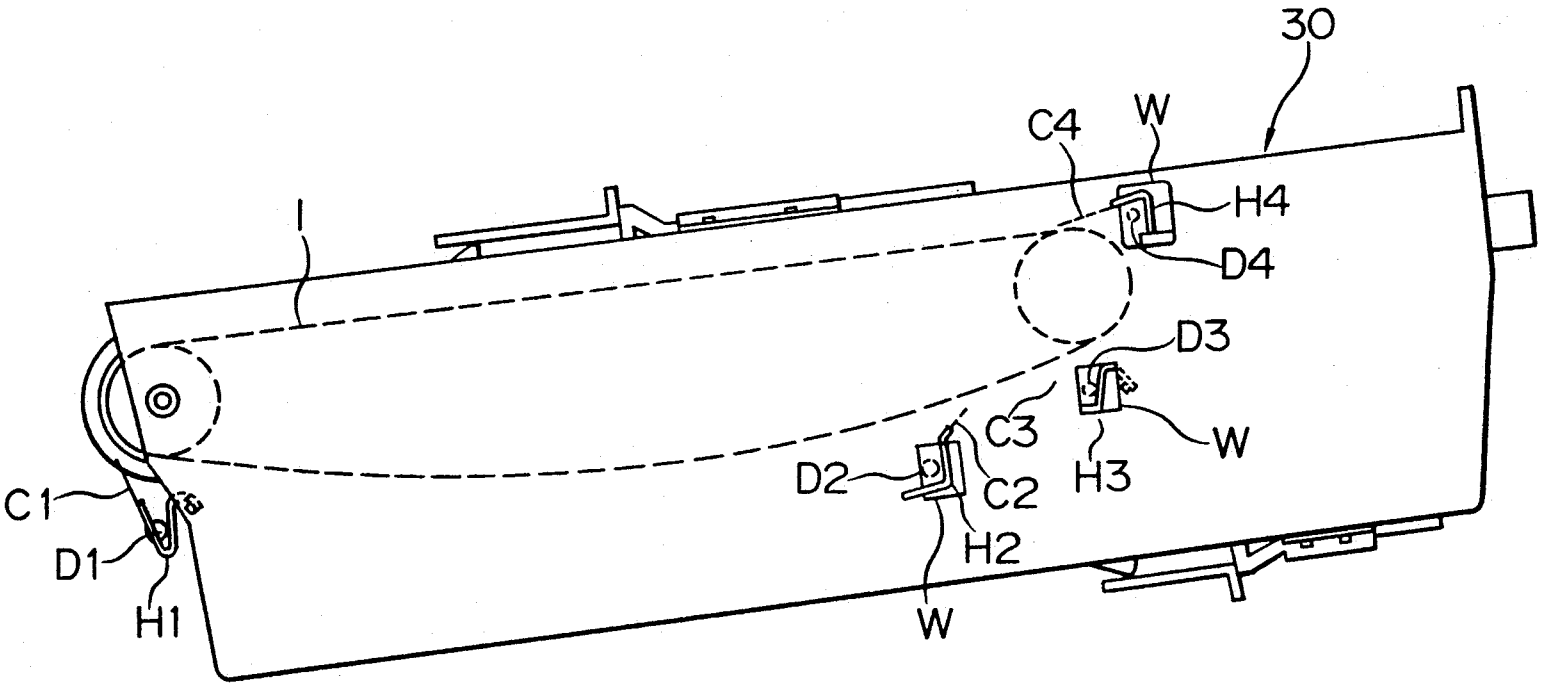
FIG. 18 is a front view of the fifth embodiment of the aforementioned process cartridge.

As illustrated in FIG. 18, the edge portions of support plates H1, H2, H3 and H4, which protrude from windows W, are pushed by push pins D1, D2, D3 and D4, respectively, which protrude from both inner sides of the apparatus. In this manner, the support plates are elastically deformed and make the tips of shielding plates C1, C2, C3 and C4 separate from the peripheral surface of the photosensitive belt 1. Accordingly, the conveyance passage of the photosensitive belt 1 can be formed.

Photosensors S1, S2 and S3 are disposed at a key point of the transfer sheet passage. In the case where a sensor located on the downstream side can not detect a transfer sheet when a predetermined period of time has passed after a sensor located on the upstream side detected a transfer sheet, a jam detection signal is outputted so that the occurrence of a jam can be detected.

The aforementioned detected signal is inputted into the control section of the apparatus and outputted as a signal to control the rotation of the aforementioned motor M1 and motor M2 which will be described later.

Figure 19:
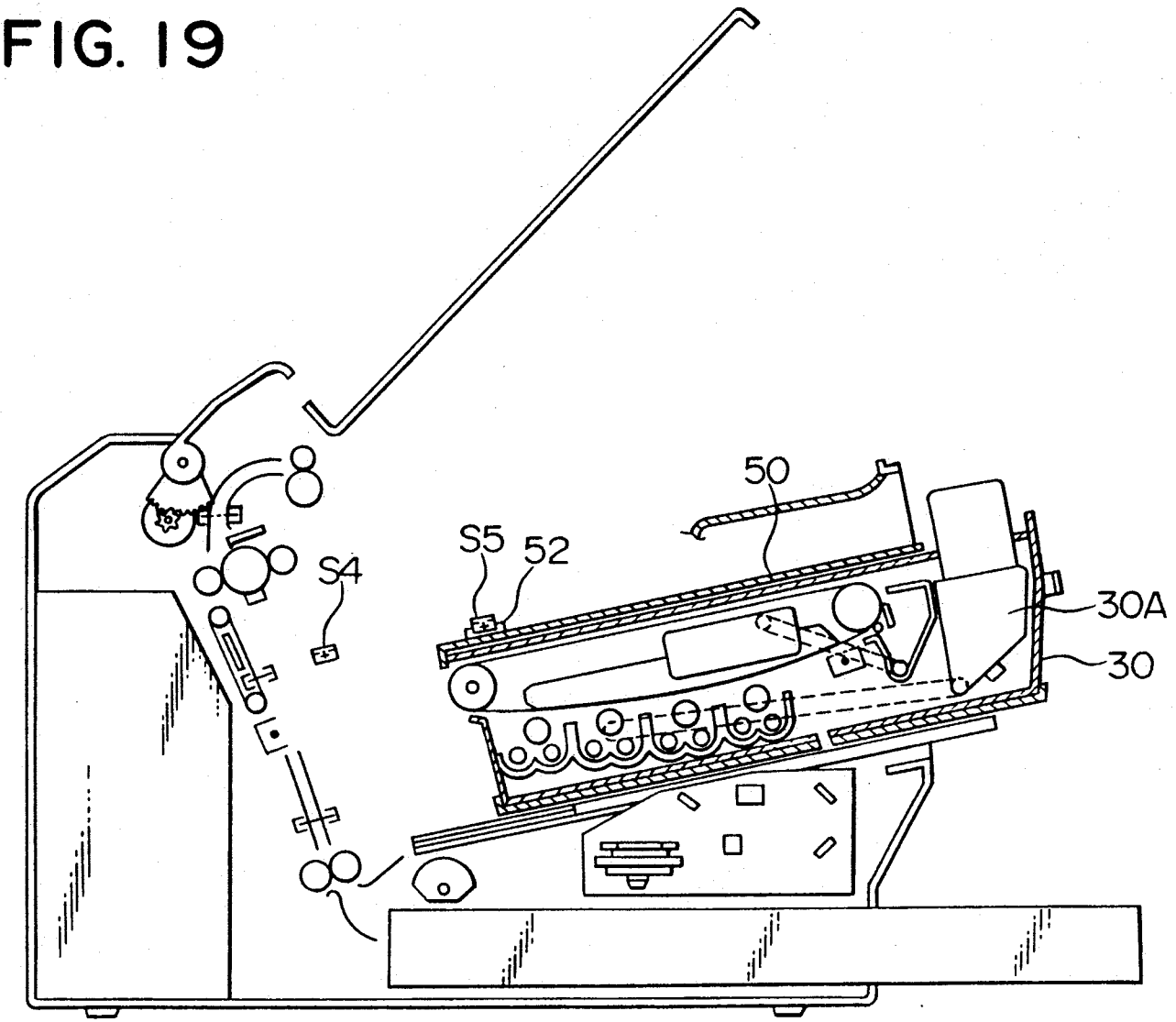
FIG. 19 is a sectional view showing the structure of the main portion of the fifth embodiment of the aforementioned apparatus.
Figure 20:
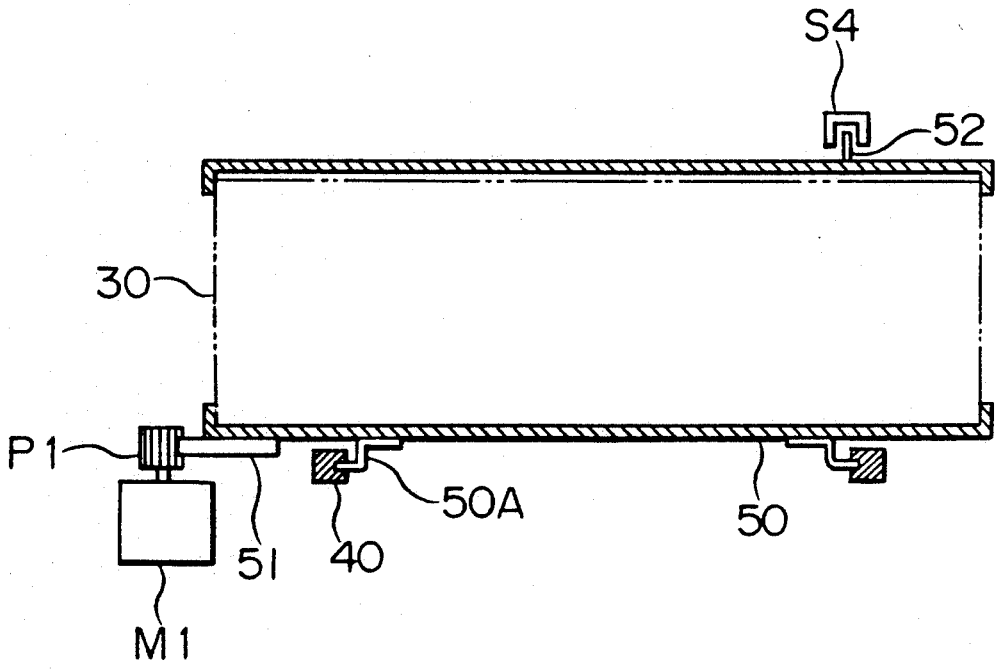
FIG. 20 is a sectional view of the main portion of the fifth embodiment of the aforementioned apparatus.

When a jam detection signal is inputted, the aforementioned motor M1 is rotated reversely, and the color process cartridge 30 is moved from the first position in which image formation is conducted, to the second position shown in FIG. 19 in which jam clearance, toner replenishment, or toner replacement is conducted.

The aforementioned reverse rotation of motor M1 is stopped when a light shielding plate 52 provided on the upper surface of the cartridge is detected by photosensor S5.

The aforementioned upper lid 20 is rotatably supported by the apparatus body through the shaft 20A, and opened when it is rotated counterclockwise, so that the upper opening portion of the apparatus is opened.

That is, the rotating base portion of the aforementioned upper lid 20 is integrally provided with a sector gear 21 which meshes with pinion P2 of motor M2 provided on the apparatus side. Accordingly, when the aforementioned motor M2 is rotated, the upper lid 20 is rotated counterclockwise as compared with the position illustrated in the drawing so that a predetermined angle can be maintained.

Under the condition described above, both shielding members 32 and 36 provided to the color process cartridge 30 are located in the closed position to protect the surface of the photosensitive belt 1, and a jammed paper is removed and toner is replenished safely.

When a reset button provided in the control section is operated, the process cartridge 30 is returned to the first position.

When the reset button is pressed, the aforementioned motor M1 is normally rotated, and the color process cartridge 30 is moved from the position shown in FIG. 19 to the position shown in FIG. 10, and stopped at the position where the aforementioned light shielding plate 52 is detected by photosensor S4.

Synchronously with the aforementioned operation, the aforementioned motor M2 is also rotated normally, and the aforementioned upper lid 20 is rotated clockwise so that the upper opening portion of the apparatus can be opened.

Even when the color process cartridge 30 is dismounted from the apparatus, the aforementioned shielding members 32, 36 are maintained in the closed position in the same manner as the case in which the color process cartridge 30 is located in the second position.

According to the present invention, the image forming apparatus can be provided which is characterized in that the replacement, inspection, and replenishment of process supplies in the image forming section can be performed at an appropriate period, and problems such as a jam can be easily and quickly treated. As a result, inspection and maintenance can be perfectly conducted, so that images of high quality can be copied, the photoreceptor can be effectively prevented from being stained with dust, so that the life can be prolonged; and as a result, the photoreceptor can be utilized over a long period of time.

It will be apparent to those skilled in the art that various modifications and variations can be made in the design and construction of the image forming apparatus of the present invention, and its overall configuration without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An image forming apparatus comprising:
(a) an image carrying member on which a latent image and corresponding toner image can be formed during an image forming operation;
(b) means for cleaning said toner image from said image carrying member;
(c) a process cartridge including said image carrying member and said cleaning means, said process cartridge being detachably mountable to said apparatus;
(d) a protective cover movably disposed to face said image carrying member in an image transfer zone thereof; and
(e) means for moving said protective cover to temporarily expose said image carrying member for a predetermined period of time during the image forming operation, and to automatically cover said image carrying member when said process cartridge is being attached to and detached from said apparatus and at times other than during said predetermined period of time when said process cartridges is detachably mounted to said apparatus.

2. The apparatus of claim 1 wherein said predetermined period of time for temporarily exposing said image carrying member is an operation period of time of said image carrying member during the image forming operation.

3. The apparatus of claim 1 wherein said predetermined period of time for temporarily exposing said image carrying member is an image transfer period of time during the image forming operation.

4. The apparatus of claim 1 wherein said process cartridge further includes a plurality of developing devices for developing said toner image on said image carrying member.

5. An image forming apparatus comprising:
(a) an image carrying member on which a latent image and corresponding toner image can be formed;
(b) means for cleaning said toner image from said image carrying member;
(c) a process cartridge including said image carrying member and said cleaning means, said process cartridge being detachably mountable to said apparatus;
(d) a protective cover movably disposed to face said image carrying member in an image transfer zone thereof; and
(e) means for moving said protective cover to temporarily expose said image carrying member in response to the input of a power source to said apparatus or the input of an image forming signal for forming the latent image, and to automatically cover said image carrying member at times other than when the input of the power source and the input of the image forming signal are provided.

6. The apparatus of claim 5 wherein said process cartridge further includes a plurality of developing devices for developing said toner image on said image carrying member.

* * * * *

UNITED STATES PATENT AND TRADEMARK OFFICE

CERTIFICATE OF CORRECTION

PATENT NO. : 5,250,989
DATED : October 5, 1993
INVENTOR(S) : Shizuo Morita et al.

It is certified that error appears in the above-indentified patent and that said Letters Patent is hereby corrected as shown below:

Claim 1, col. 20, lines 25-26, change "cartridges" to --cartridge--.

Signed and Sealed this

Fifth Day of July, 1994

Bruce Lehman

*Attest:*

BRUCE LEHMAN

*Attesting Officer*

*Commissioner of Patents and Trademarks*